US005370978A

United States Patent [19]

Takahashi

[11] Patent Number: 5,370,978

[45] Date of Patent: Dec. 6, 1994

[54] SILVER HALIDE COLOR PHOTOSENSITIVE MATERIAL

[75] Inventor: Osamu Takahashi, Kanagawa, Japan

[73] Assignee: Fuji Photo Film Co., Ltd., Kanagawa, Japan

[21] Appl. No.: 63,086

[22] Filed: May 18, 1993

[30] Foreign Application Priority Data

May 18, 1992 [JP] Japan ..... 4-148926

[51] Int. Cl.[5] ..... G03C 1/46

[52] U.S. Cl. ..... 430/505; 430/558; 430/546; 430/384; 430/385

[58] Field of Search ..... 430/558, 384, 385, 546, 430/505

[56] References Cited

U.S. PATENT DOCUMENTS

| | | | |
|---|---|---|---|
| 5,009,989 | 4/1991 | Aoki et al. | 430/546 |
| 5,077,188 | 12/1991 | Tanji et al. | 430/546 |
| 5,082,764 | 1/1992 | Takahashi | 430/546 |
| 5,200,303 | 4/1993 | Takahashi et al. | 430/546 |
| 5,256,526 | 10/1993 | Suzuki et al. | 430/385 |
| 5,270,153 | 12/1993 | Suzuki et al. | 430/558 |

FOREIGN PATENT DOCUMENTS

| | | |
|---|---|---|
| 0488248 | 6/1992 | European Pat. Off. . |
| 0491197 | 6/1992 | European Pat. Off. . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

Disclosed is a silver halide color photographic material which contains the combination of a pyrroloazole type cyan coupler and a carboxylic acid ester type high boiling organic solvent having a dielectric constant of at most 6.0 in a cyan color-forming silver halide emulsion layer and further contains a pyrazoloazole type magenta coupler in a magenta color-forming silver halide emulsion layer, thereby acquiring high color formability, excellent color reproducibility and preventing stains from generating in the white area after photographic processing.

16 Claims, No Drawings

SILVER HALIDE COLOR PHOTOSENSITIVE MATERIAL

FIELD OF THE INVENTION

The present invention relates to a silver halide color photosensitive material and, more particularly, to a silver halide photosensitive material which not only has excellent color reproducibility but also ensures a high keeping quality in the color images, particularly a substantial reduction of stain generation in the white area upon storage, after photographic processing.

BACKGROUND OF THE INVENTION

In silver halide color photosensitive materials, there are used light-sensitive silver halide emulsions and so-called dye-forming couplers (abbreviated as "couplers" hereinafter) which form dyes by reacting with the oxidation product of an aromatic primary amine developing agent. In general, color images are formed by the subtractive color process using a combination of yellow, magenta and cyan couplers.

As for the magenta couplers, the 5-pyrazolone type magenta couplers which contain an acylamino group or an anilino group at the 3-position and a phenyl group at the 1-position are well known. On the other hand, pyrazoloazole type magenta couplers have achieved a rapid development in recent years, and the practical use thereof in photosensitive materials for picture-taking purposes and in those for viewing purposes, such as color prints, color slide and color display, is now well under way because unlike conventional 5-pyrazolone type magenta couplers they have some desirable characteristics, for instance, they can provide excellent color reproducibility since the dyes formed therefrom have an absorption characteristic such that there is no secondary absorption in the wavelength region shorter than the wavelengths of their main absorption (about 430 nm), and they can provide color images of high fastness.

As for the cyan couplers, phenol type couplers and naphthol type couplers are well known. In recent years, however, various new couplers have been proposed with a progress of researches on couplers which have more desirable color-forming characteristics and can provide color images of higher fastness and more excellent color reproducibility with the intention of introducing improvements in the color formation characteristics of phenol type and naphthol type couplers (including coupling activities of the couplers and molar absorption coefficients of the dyes obtained therefrom) and in the fastness and the absorption characteristics of the color images obtained from the couplers of said types. Examples of such cyan couplers include the 3-hydroxypyridine compounds disclosed in EP-A-0033105, the 3H-2-dicyanomethylidenethiazoles disclosed in EP-A-0362808, the 3-dicyanomethylidene-2,3-dihydrobenzothiophene-1,1-dioxides disclosed in JP-A-64-32260 (the term "JP-A" as used herein means an "unexamined published Japanese patent application"), the pyrazoloazoles disclosed in JP-A-63-264753 and U.S. Pat. No. 4,873,183, the imidazoles disclosed in U.S. Pat. Nos. 4,818,672 and 4,921,783, JP-A-03-48243 and so on, the pyrazolopyrimidones and the pyrazoloquinazolones disclosed in EP-A-0304001, EP-A-0329036, EP-A-0374781 and JP-A-02-85851, and the ring-condensed triazoles disclosed in EP-A-0342637.

However, not all the desirable characteristics described above, including excellent color forming characteristics, high fastness of color image and excellent color reproducibility, are inherent in such new cyan couplers. Therefore, it is the state of things that further improvements and researches on those cyan couplers are required for practical use.

On the other hand, the couplers containing 1H-pyrrolo[1,2-b][1,2,4]triazole as a mother nucleus are described in the notes of lectures at the annual convention of Japanese Photographic Society in the 60th year of Showa (held on May 23 and 24 in 1985, at Shigaku Kaikan), pages 108–110, and disclosed in JP-A-62-279340 and JP-A-62-278552. Such couplers produce magenta dyes. Since these magenta dyes show broader absorption spectra than those produced from the foregoing pyrazolotriazole type magenta couplers, it cannot be said that said couplers provide satisfactory hue.

Although it is a fact that silver halide photosensitive materials excellent in reproducibility of colors of red series have been obtainable since the practical use of the foregoing pyrazolotriazole type magenta couplers got under way, there have been a further desire for silver halide photosensitive materials which ensure excellent reproducibility of colors of green series and blue series as well as red series and the prevention of stain after photographic processing to provide photographs retaining their beauty permanently.

As described above, even when cyan and magenta couplers which have undergone improvements in characteristics including color forming characteristics, fastness of color image produced therefrom, color reproducibility and so on are incorporated in photosensitive materials, it is a general tendency that not all the improved characteristics are used efficiently and, far from it, some of them occasionally bring about adverse results. For instance, even when the color reproducibility of a coupler is improved, the coupler cannot be practically used if it causes marked deterioration in the color reproducibility, e.g., by gradually staining the white area of the photosensitive material with the lapse of time after photographic processing, because it is inferior in image storage characteristics.

SUMMARY OF THE INVENTION

Therefore, an object of the present invention is to provide a silver halide color photosensitive material which is not only excellent in color forming characteristics and color reproducibility but also reduced in the stain generating in the white area thereof after photographic processing.

As a result of our intensive studies, it has now been found that the object of the present invention can be attained with silver halide color photosensitive materials having the following constitutions:

1) A silver halide color photosensitive material having on a support a cyan color-forming silver halide emulsion layer, said emulsion layer comprising at least one cyan dye-forming coupler represented by the following general formula (Ia) and a high boiling organic solvent having the following general formula (S) and a dielectric constant of at most 6.0;

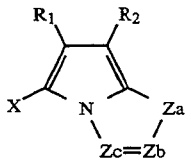

(Ia)

wherein za represents —NH— or —CH($R_3$)—; Zb and Zc each represent —C($R_4$)= or —N=; $R_1$, $R_2$ and $R_3$ each represent an electron-withdrawing group having a Hammett's substituent constant $\sigma_P$ of at least 0.20, provided that the sum of the $\sigma_P$ values of $R_1$ and $R_2$ is at least 0.65; $R_4$ represents a hydrogen atom or a substituent group, and when two $R_4$'s are present in the formula they may be the same or different; and X represents a hydrogen atom or a group capable of splitting off by the coupling reaction with the oxidation product of an aromatic primary amine color developing agent;

$R_5$—$COOR_6$ (S)

wherein $R_5$ and $R_6$ each represent a substituted or unsubstituted alkyl, cycloalkyl, alkenyl, aryl or heterocyclyl group:

2) The silver halide color photosensitive material described in the foregoing paragraph 1), which further has on the support a magenta color-forming silver halide emulsion layer and a yellow color-forming silver halide emulsion layer, said magenta color-forming silver halide emulsion layer containing at least one magenta dye-forming coupler represented by the following general formula (II);

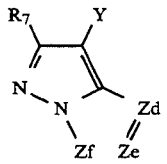

(II)

wherein $R_7$ represents a hydrogen atom or a substituent group; Zd, Ze and Zf each represent an unsubstituted or substituted methine group, =N— or —NH—; and Y represents a hydrogen atom or a group capable of splitting off by the coupling reaction with the oxidation product of a developing agent: and 3) The silver halide color photosensitive material described in the foregoing paragraph 1) or 2), wherein the ratio of the high boiling organic solvent of general formula (S) to the cyan dye-forming coupler of general formula (Ia) is at least 1.0 by weight.

In accordance with embodiments of the present invention, there can be obtained excellent photosensitive materials which have high color formability and excellent color reproducibility, and hardly generate stains in the white area after photographic processing.

DETAILED DESCRIPTION OF THE INVENTION

The compounds of the present invention are described below in detail.

The present cyan couplers having general formula (Ia) specifically include those represented by the following general formulae (IIa) to (VIIIa):

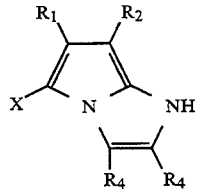

(IIa)

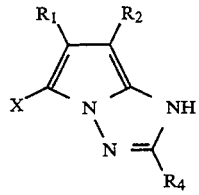

(IIIa)

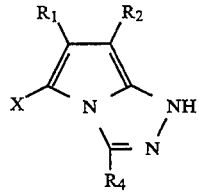

(IVa)

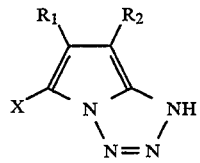

(Va)

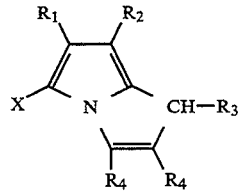

(VIa)

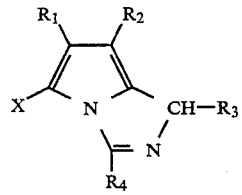

(VIIa)

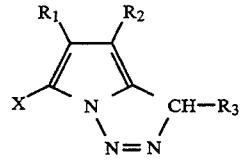

(VIIIa)

wherein $R_1$, $R_2$, $R_3$, $R_4$ and X have the same meanings as in general formula (Ia), respectively.

The cyan couplers which are preferable in the present invention are those represented by general formulae (IIa), (IIIa) and (IVa), especially those represented by general formula (IIIa).

In the cyan couplers of the present invention, all the substituents $R_1$, $R_2$ and $R_3$ are electron-withdrawing groups having a $\sigma_P$ value of at least 0.20, and the sum of the $\sigma_P$ values of $R_1$ and $R_2$ is at least 0.65. It is desirable for the sum of the $\sigma_P$ values of $R_1$ and $R_2$ to be at least 0.70, and the upper limit of said sum is not much exceeding 1.8.

$R_1$, $R_2$ and $R_3$ each are, as described above, an electron-withdrawing group having a Hammett's substituent constant $\sigma_P$ of at least 0.2. Each is preferably an electron-withdrawing group having a $\sigma_P$ value of at least 0.35, and much preferably an electron-withdrawing group having a $\sigma_P$ value of at least 0.60. With respect to the $\sigma_P$ value, the electron-withdrawing group has the upper limit of no greater than 1.0. The Hammett' rule is the empirical rule proposed by L. P. Hammett in 1935 in order to treat quantitatively the effects of substituent groups upon the reaction or the equilibrium of benzene derivatives, and its validity is universally appreciated in these times. The substituent constants determined by the Hammett's rule are $\sigma_P$ and $\sigma_m$ values. We can find the description of these values in many general books. For instance, there are detailed descriptions in J. A. Dean, *Lange's Handbook of Chemistry*, 12th edition, McGraw-Hill (1979), and *Kagaku no Ryo-iki Zokan* (which means special numbers of "Domain of Chemistry"), number 122, pages 96–103, Nankodo, Tokyo (1979). In the present invention, $R_1$, $R_2$ and $R_3$ are specified definitely using a Hammett's substituent constant $\sigma_P$. Additionally, these substituents should not be construed as being limited to the substituents whose $\sigma_P$ values are already known through the references adopted in the foregoing books, but it is a matter of course that they include any substituents whose $\sigma_P$ values are within the range defined by the present invention when determined by the Hammett' rule even if they are not yet reported in literature.

Specific examples of electron-withdrawing groups having a $\sigma_P$ value of at least 0.20, which are represented by $R_1$, $R_2$ and $R_3$, include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphino group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenoalkyl group, a halogenoalkoxy group, a halogenoaryloxy group, a halogenoalkylamino group, a halogenoalkylthio group, an aryl group substituted with other electron-withdrawing groups having a $\sigma_P$ value of at least 0.20, a heterocyclyl group, a halogen atom, an azo group and a selenocyanate group. These groups may further have substituents such as examples of the group represented by $R_4$ (described hereinafter), provided that they can afford room for substituent groups.

More specifically describing $R_1$, $R_2$ and $R_3$, the electron-withdrawing groups whose $\sigma_P$ values are at least 0.20 include an acyl group (e.g., acetyl, 3-phenylpropanoyl, benzoyl, 4-docecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, N-{3-(2,4-di-t-amylphenoxy)-propyl}carbamoyl), an alkoxycarbonyl group (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycarbonyl, 2-decyl-hexyloxycarbonylmethoxycarbonyl), an aryloxycarbonyl group (e.g., phenoxycarbonyl, 2,5-di-amylphenoxycarbonyl), a cyano group, a nitro group, a dialkylphosphono group (e.g., dimethylphosphono), a diarylphosphono group (e.g., diphenylphosphono), a diarylphosphino group (e.g., diphenylphosphino), an alkylsulfinyl group (e.g., 3-phenyloxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanate group, a thiocarbonyl group (e.g., methylthiocarbonyl, phenylthiocarbonyl), a halogenoalkyl group (e.g., trifluoromethyl, heptafluoropropyl), a halogenoalkoxy group (e.g., trifluoromethyloxy), a halogenoaryloxy group (e.g., pentafluorophenyloxy), a halogenoalkylamino group (e.g., N,N-di-(trifluoromethyl)amino), a halogenoalkylthio group (e.g., difluoromethylthio, 1,1,2,2-tetrafluoroethylthio), an aryl group substituted with other electron-withdrawing groups having a $\sigma_P$ value of at least 0.20 (e.g., 2,4-dinitrophenyl, 2,4,6-trichlorophenyl, pentachlorophenyl), a heterocyclyl group (e.g., 2-benzoxazolyl, 2-benzothiazolyl, 1-phenyl-2-benzimidazolyl, 5-chloro-1-tetrazolyl, 1-pyrrolyl), a halogen atom (e.g., chlorine, bromine), an azo group (e.g., phenylazo) and selenocyanate group.

As for the representative electron-withdrawing groups, their $\sigma_P$ values are given below in parenthesis after the corresponding groups:

Cyano group (0.66), nitro group (0.78), trifluoromethyl group (0.54), acetyl group (0.50), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), pyrazolyl group (0.37), methanesulfonyloxy group (0.36), dimethoxyphosphoryl group (0.60), sulfamoyl group (0.57), and so on.

Substituent groups desirable for $R_1$, $R_2$ and $R_3$ include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenoalkyl group, a halogenoalkyloxy group, a halogenoalkylthio group, a halogenoaryloxy group, a halogenoaryl group, an aryl group substituted with at least two nitro groups, and a heterocyclyl group. Of these groups, an acyl group, an alkoxycarbonyl group, an aryloxycarbonyl group, a nitro group, a cyano group, an arylsulfonyl group, a carbamoyl group and a halogenoalkyl group are preferable. Much preferable ones are a cyano group, an alkoxycarbonyl group, an aryloxycarbonyl group and a halogenoalkyl group. In particular, a cyano group; a trifluoromethyl group; a straight or branched unsubstituted alkoxycarbonyl group; an alkoxycarbonyl group substituted with a carbamoyl group; an ether linkage-containing alkoxycarbonyl group; an unsubstituted aryloxycarbonyl group; and an aryloxycarbonyl group substituted with alkyl or alkoxy groups are preferred over others. As for the combination of $R_1$ and $R_2$, it is preferable that $R_1$ be a cyano group and $R_2$ be a trifluoromethyl group; a straight- or branched-chain unsubstituted alkoxycarbonyl group; an alkoxycarbonyl group substituted with a carbamoyl group; an ether linkage-containing alkoxycarbonyl group; or an aryloxycarbonyl group which may be unsubstituted one or substituted with an alkyl or alkoxy group.

$R_4$ represents a hydrogen atom or a substituent group (including an atom). Specific examples of the substituent group include a halogen atom, an aliphatic group, an aryl group, a heterocyclyl group, an alkoxy group, an aryloxy group, a heterocyclyloxy group, an alkyl-, aryl- or heterocyclylthio group, an acyloxy group, a carbamoyloxy group, a silyloxy group, a sulfonyloxy group, an acylamino group, an alkylamino group, an arylamino group, an ureido group, a sulfamoylamino group, an alkenyloxy group, a formyl group, an alkyl-, aryl- or heterocyclylacyl group, an alkyl-, aryl- or heterocyclylsulfonyl group, an alkyl-, aryl- or heterocyclylsulfinyl group, an alkyl-, aryl- or heterocyclyloxycarbonyl group, an alkyl-, aryl- or heterocyclyloxycarbonylamino group, a sulfonamido group, a carbamoyl group, a sulfamoyl group, a phosphonyl group, a sulfamido group, an imido group, an azolyl group, a hydroxy group, a cyano group, a carboxyl group, a nitro group, a sulfo group, and an unsubstituted amino group. The alkyl, aryl or heterocyclyl moieties contained in the above-cited groups may further be substituted with group(s) as instanced in the description of $R_4$.

More specifically, $R_4$ represents a hydrogen atom, a halogen atom (e.g., chlorine, bromine), an aliphatic group (including straight-chain or branched alkyl, aralkyl, alkenyl, alkinyl, cycloalkyl and cycloalkenyl groups which each contain 1 to 36 carbon atoms, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl )phenoxy]-dodecanamido}phenyl}propyl, 2-ethoxytridecyl, trifluoromethyl, cyclopentyl, 3-(2,4-di-t-amylphenoxy)propyl), an aryl group (preferably containing 6 to 36 carbon atoms, e.g., phenyl, naphthyl, 4-hexadecoxyphenyl, 4-t-butylphenyl, 2,4-di-t-amylphenyl, 4-tetradecanamidophenyl, 3-(2,4-di-tert-amylphenoxyacetamido)phenyl), a heterocyclyl group (e.g., 3-pyridyl, 2-furyl, 2-thienyl, 2-pyridyl, 2-pyrimidinyl, 2-benzothiazolyl), an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, 3-methoxycarbamoylphenoxy), a heterocyclyloxy group (e.g., 2-benzimidazolyloxy, 1-phenyltetrazole-5-oxy, 2-tetrahydropyranyloxy), an alkyl, aryl or heterocyclic thio group (e.g., methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecanamidophenylthio, 2-benzothiazolylthio, 2,4-di-phenoxy-1,3,4-triazole-6-thio, 2-pyridylthio), an acyloxy group (e.g., acetoxy, hexadecanoyloxy), a carbamoyloxy group (e.g., N-ethylcarbamoyloxy, N-phenylcarbamoyloxy), a silyloxy group (e.g., trimethylsilyloxy, dibutylmethylsilyloxy), a sulfonyloxy group (e.g., dodecylsulfonyloxy), an acylamino group (e.g., acetamido, benzamido, tetradecanamido, 2-(2,4-di-tert-amylphenoxy)acetamido, 2-[4-(4-hydroxyphenylsulfonyl)phenoxy)]decanamido, isopentadecanamido, 2-(2,4-di-tert-amylphenoxy)-butanamido, 4-(3-t-butyl-4-hydroxyphenoxy)-butanamido), an alkylamino group (e.g., methylamino, butylamino, dodecylamino, dimethylamino, diethylamino, methylbutylamino), an arylamino group (e.g., phenylamino, 2-chloroanilino, 2-chloro-5-tetradecanamidoanilino, N-acetylanilino, 2-chloro-5-[α-(2-tert-butyl-4-hydroxyphenoxy)dodecanamido]anilino, 2-chloro-5-dodecyloxycarbonylanilino), an ureido group (e.g., methylureido, phenylureido, N,N-dibutylureido, dimethylureido), a sulfamoylamino group (e.g., N,N-dipropylsulfamoylamino, N-methyl-N-decylsulfamoylamino), an alkenyloxy group (e.g., 2-propenyloxy), a formyl group, an alkyl, aryl or heterocyclic acyl group (e.g., acetyl, benzoyl, 2,4-di-tert-amylphenylacetyl, 3-phenylpropanoyl, 4-dodecyloxybenzoyl), an alkyl, aryl or heterocyclic sulfonyl group (e.g., methanesulfonyl, octanesulfonyl, benzenesulfonyl, toluenesulfonyl), a sulfinyl group (e.g., octanesulfinyl, dodecylsulfinyl, phenylsulfinyl, 3-pentadecylphenylsulfinyl, 3-phenoxypropylsulfinyl), an alkyl, aryl or heterocyclic oxycarbonyl group (e.g., methoxycarbonyl, butoxycarbonyl, dodecyloxycarbonyl, octadecyloxycarbonyl, phenyloxycarbonyl, 2-pentadecyloxycarbonyl), an alkyl, aryl or heterocyclic oxycarbonylamino group (e.g., methoxycarbonylamino, tetradecyloxycarbonylamino, phenoxycarbonylamino, 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecyl-carbamoyl, N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a phosphonyl group (e.g., phenoxyphosphonyl, octyloxyphosphonyl, phenylphosphonyl), a sulfamido group (e.g., dipropylsulfamoylamino), an imido group (e.g., N-succinimdo, hydantoinyl, N-phthalimido, 3-octadecenylsuccinimido), an azolyl group (e.g., imidazolyl, pyrazolyl, 3-chloro-pyrazole-1-yl, triazolyl), a hydroxy group, a cyano group, a carboxyl group, a nitro group, a sulfo group, an unsubstituted amino group or so on.

Groups preferred as $R_4$ are an alkyl group, an aryl group, a heterocyclyl group, a cyano group, a nitro group, an acylamino group, an arylamino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocylyloxy group, an acyloxy group, a carba-moyloxy group, an aryloxycarbonylamino group, an imido group, a heterocyclylthio group, a sulfinyl group, a phosphonyl group, an acyl group and an azolyl group.

Of the above-cited groups, an alkyl group and an aryl group are much preferable. Further, it is desirable for these groups to be substituted with at least one alkoxy, sulfonyl, sulfamoyl, carbamoyl, acylamido or sulfonamido group. An especially preferred group as $R_4$ is an alkyl or aryl group containing at least one acylamido or sulfonamido group as substituent.

X in general formula (Ia) represents a hydrogen atom or a group capable of splitting off when the coupler reacts with the oxidation product of an aromatic primary amine color developing agent (the group is abbreviated as "a splitting-off group" hereinafter). When X represents a splitting-off group, the splitting-off group includes a halogen atom; an aromatic azo group; an alkyl, aryl, heterocyclyl, alkyl- or arylsulfonyl, arylsulfinyl, alkyl- or arylcarbonyl, or alkyl-, aryl- or heterocyclylcarbonyl group which is attached to the coupling site via an oxygen, nitrogen, sulfur or carbon atom; and a heterocyclyl group which is attached to the coupling site via the nitrogen atom thereof. Specifically, a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclylthio group, a carbamoylamino group, an arylsulfinyl group, an arylsulfonyl group, a 5- or 6-membered nitrogen-containing heterocyclyl group, an imido group and an arylazo group are examples of the splitting-off group. The alkyl, aryl or heterocyclyl moiety contained in the splitting-off group may further be substituted with group(s) included in specific examples of $R_4$. When such a moiety has two or more substituents, the substituents may be the same or different and may further have a substituent as instanced in the description of $R_4$.

More specifically, the splitting-off group includes a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamido, trifluoromethanesulfonylamido, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclylthio group (e.g., ethylthio, 2-carboxyethylthio, dodecylthio, 1-carboxydodecylthio, phenylthio, 2-butoxy-5-tert-octylphenylthio, tetrazolylthio), an arylsulfonyl group (e.g., 2-butoxy-5-tert-octylphenylsulfonyl), an arylsulfinyl group (e.g., 2-butoxy-5-tert-octylphenylsulfinyl), a carbamoylamino group (e.g., N-methylcarbamoylamino, N-phenylcarbamoylamino), a 5- or 6-membered nitrogen-containing heterocyclyl group (e.g., imidazolyl, pyrazolyl, triazolyl, tetrazolyl, 1,2-dihydro-2-oxo-1-pyridyl), an imido group (e.g., succinimido, hydantoinyl), an arylazo group (e.g., phenylazo, 4-methoxyphenylazo) and so on. Of course, the groups cited above may further be substituted with substituent(s) instanced in the description of $R_4$. In addition, splitting-off groups of the type which are attached to the coupling site via a carbon atom include those which constitute bis-type couplers formed by condensing four-equivalent couplers through aldehydes or ketones. The splitting-off groups used in the present invention may contain a photographically useful group, such as a development inhibitor residue, a development accelerator residue or so on.

It is preferable for X to be a halogen atom, an alkoxy group, an aryloxy group, an alkyl- or arylthio group, an arylsulfonyl group, an arylsulfinyl group or a 5- or 6-membered nitrogen-containing heterocyclyl group which is attached to the coupling active site via the nitrogen atom thereof. Of these groups, an arylthio group is much preferable.

The cyan coupler represented by general formula (Ia) may be a dimer or higher polymer formed by containing one or more residues of the cyan coupler of general formula (Ia) in the substituent group $R_1$, $R_2$, $R_3$, $R_4$ or X, or may be a homopolymer or copolymer formed by containing a high molecular chain in the substituent group $R_1$, $R_2$, $R_3$, $R_4$ or X. The expression "a homopolymer or copolymer formed by containing a high-molecular chain" as used herein is intended to include, as typical examples, polymers consisting of or comprising addition-polymerizable ethylenic unsaturated compounds which each contains a residue of the cyan coupler represented by general formula (Ia). All the cyan color-forming repeating units present in the polymer may not be the same, and the copolymerizing component may be constituted of the same or different ethylenic monomers which do not form any color because they cannot couple with the oxidation product of an aromatic primary amine developer, such as acrylic acid esters, methacrylic acid esters and maleic acid esters.

Specific examples of the cyan coupler of the present invention are illustrated below. However, the invention should not be construed as being limited to these examples.

I-1
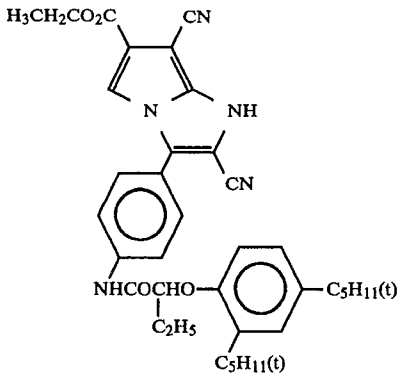
I-2
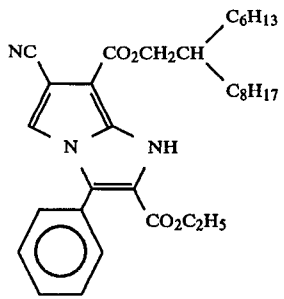
I-3
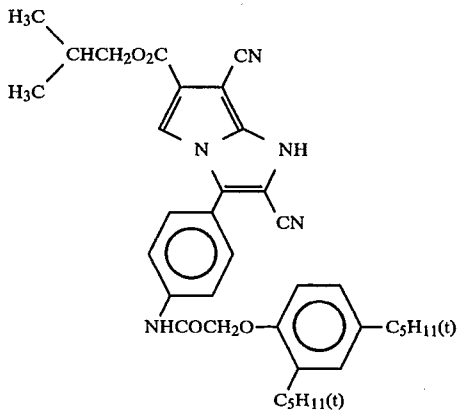
I-4
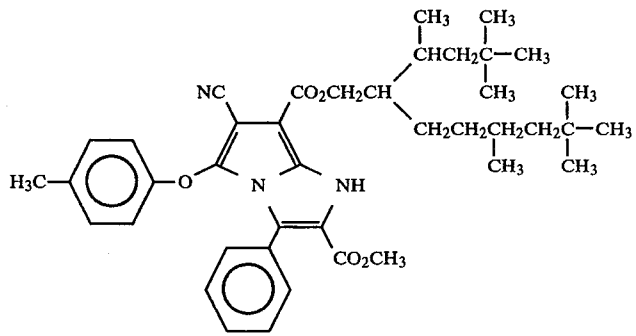
I-5
I-6

-continued
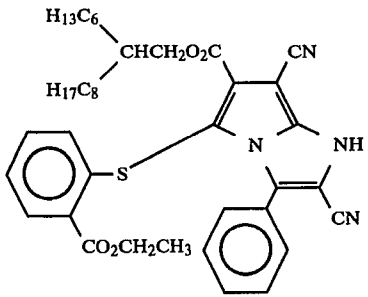
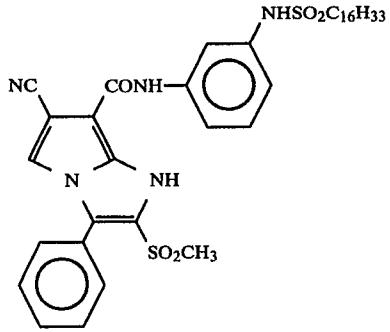
I-7
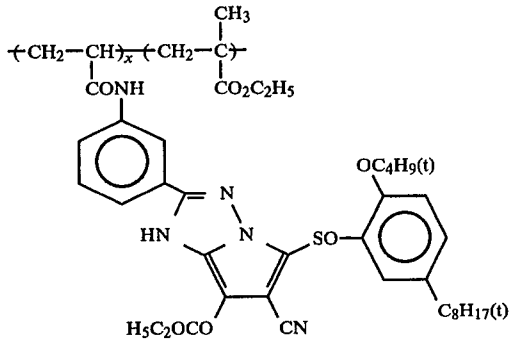
X:Y = 50:50 (by mole)
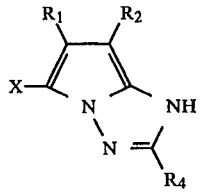
| No. | $R_1$ | $R_2$ | $R_4$ | X |
|---|---|---|---|---|

-continued
| | | | | |
|---|---|---|---|---|
| 8 | $CO_2CH_3$ | CN | 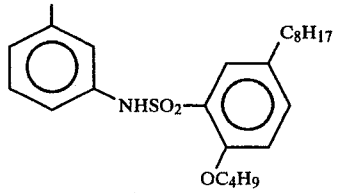 | H |
| 9 | CN | 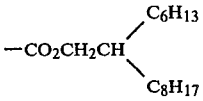 | 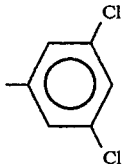 | H |
| 10 | CN | 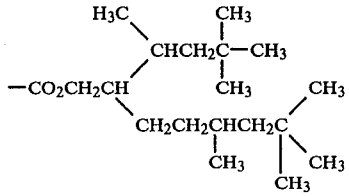 | 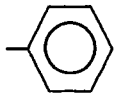 | H |
| 11 | CN | 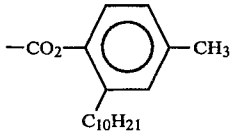 | 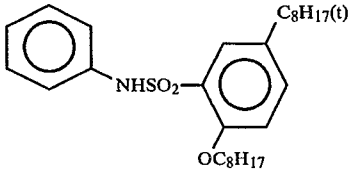 | H |
| 12 | CN | 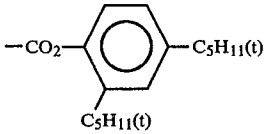 | 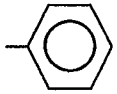 | H |
| 13 | CN | 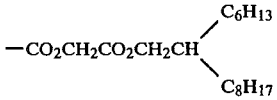 | 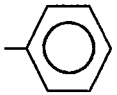 | H |

-continued
| | | | | |
|---|---|---|---|---|
| 14 | CN | $-CO_2CH_2CH_2(CF_2)_6F$ | 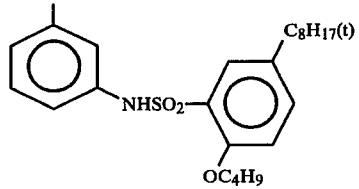 | H |
| 15 | CN | 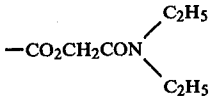 | 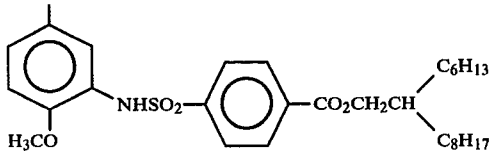 | 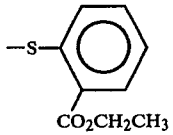 |
| 16 | CN | $-CO_2CH_2CH_2(CF_2)_6F$ | 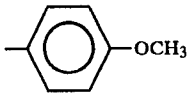 | 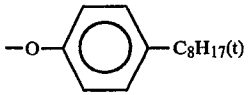 |
| 17 | CN | 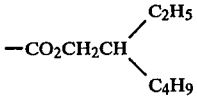 | 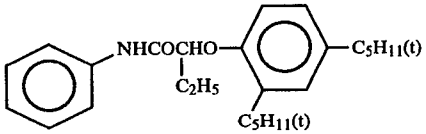 | 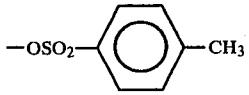 |
| 18 | CN | 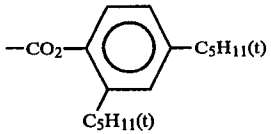 | 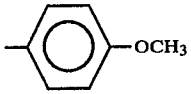 | 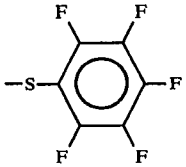 |
| 19 | CN | 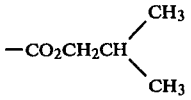 | 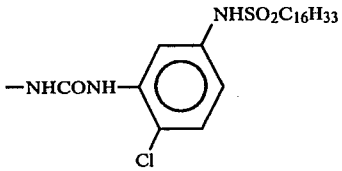 | 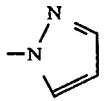 |

-continued
| | | | | |
|---|---|---|---|---|
| 20 | CN | $-CO_2CH_2(CF_2)_4H$ | 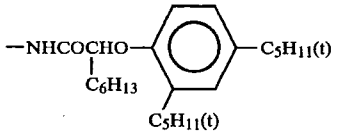 | 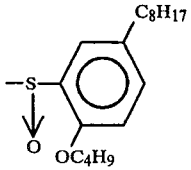 |
| | | 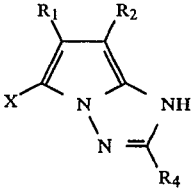 | | |
| 21 | CN | 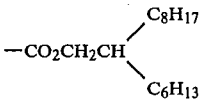 | 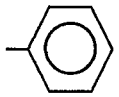 | H |
| 22 | 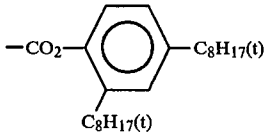 | CN | 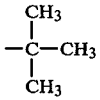 | 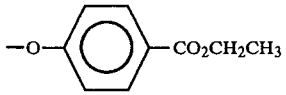 |
| 23 | $-CO_2CH_2C_6F_{13}$ | CN | 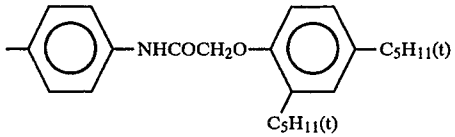 | Cl |
| 24 | 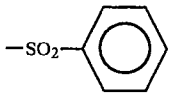 | 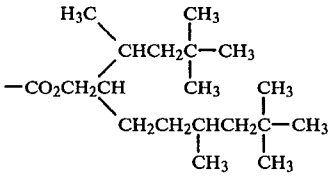 | $CH_3$ | $-OCOCH_3$ |

-continued
| | | | | |
|---|---|---|---|---|
| 25 | CN | $-CO_2CH_2CO_2CH_3$ | 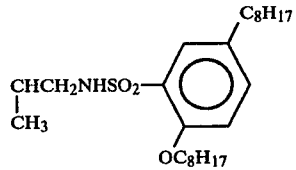 | 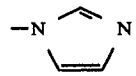 |
| 26 | CN | 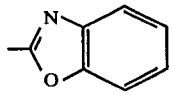 | 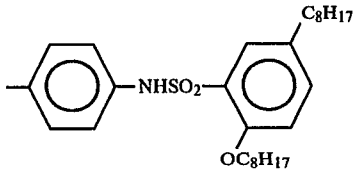 | 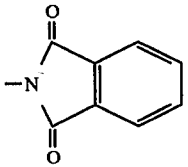 |
| 27 | CN | $CF_3$ | 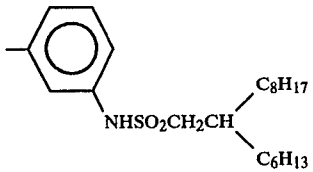 | Cl |
| 28 | 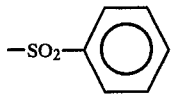 | $CF_3$ | 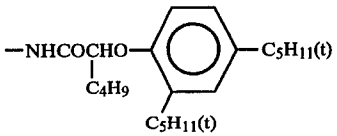 | F |
| 29 | CN | 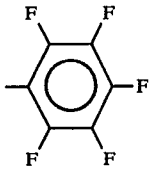 | 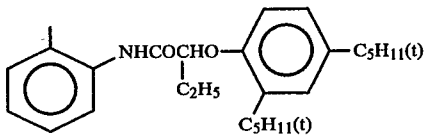 | 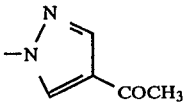 |
| 30 | 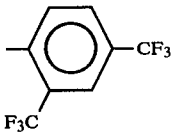 | $-SO_2Ph$ | 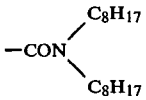 | 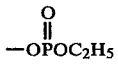 |

-continued
| | | | | |
|---|---|---|---|---|
| 31 | CN | 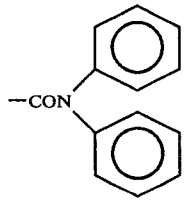 | 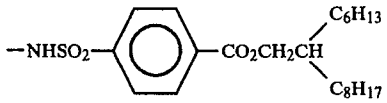 | 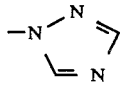 |
| 32 | CN | 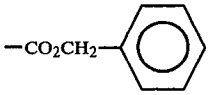 | 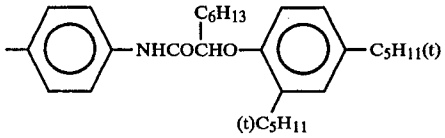 | H |
| 33 | CN | 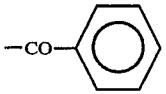 | 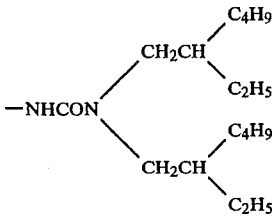 | $-OSO_2CH_3$ |
| | | 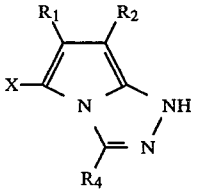 | | |
| 34 | $-CO_2C_2H_5$ | CN | 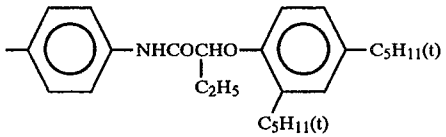 | Cl |

-continued
| | | | | |
|---|---|---|---|---|
| 35 | CN | 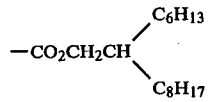 | 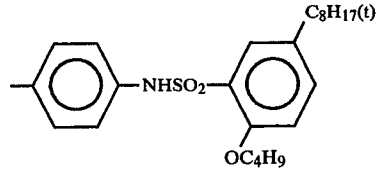 | H |
| 36 | CN | $-CO_2CH_2CH_2(CF_2)_6F$ | 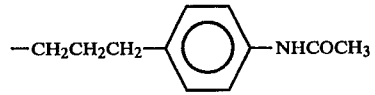 | 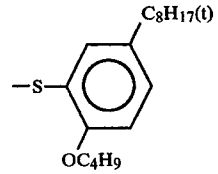 |
| 37 | CN | 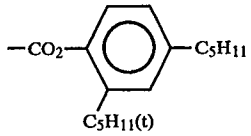 | 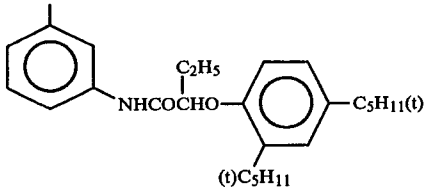 | 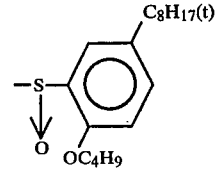 |
| 38 | CN | 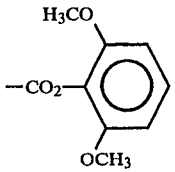 | 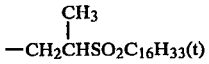 | 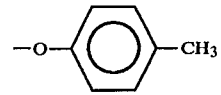 |
| 39 | CN | 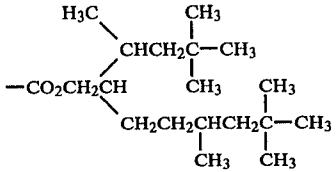 | 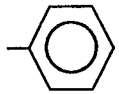 | H |

-continued
| | | | | |
|---|---|---|---|---|
| 40 | CN | $-CO_2CH(CH_3)_2$ | 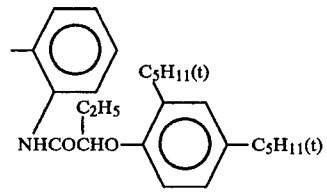 | Cl |
| 41 | CN | $-CON(C_2H_5)_2$ | 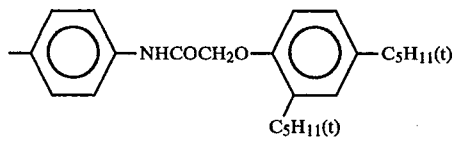 | $-OSO_2CH_3$ |
I-42
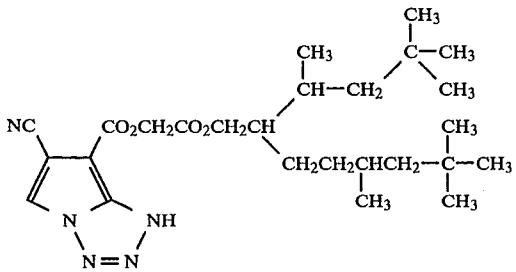
I-43
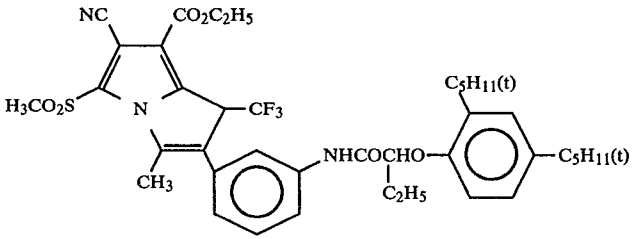
I-44
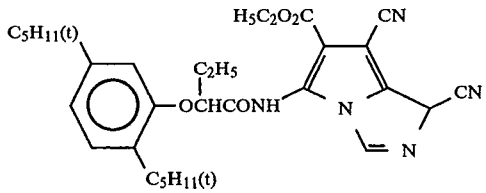
I-45
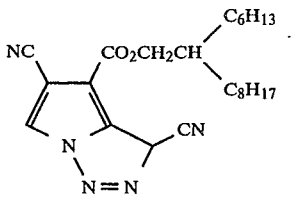
I-46

-continued
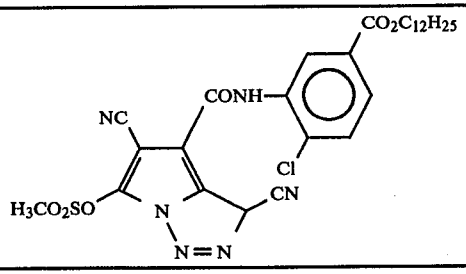

The couplers of the present invention and the intermediates thereof can be synthesized according to known methods. For instance, the synthesis methods described in *J. Am. Chem. Soc.*, volume 80, page 5332 (1958), *J. Ame. Chem.*, volume 81. page 2452 (1959), *J. Am. Chem. soc.*, volume 112, page 2465 (1990), *Org. Synth.*, page 1270 (1941), *J. Chem. Soc.*, page 5149 (1962), *Heterocyclic.*, volume 27, page 2301 (1988), *Rec. Tray. Chim.*, volume 80, page 1075 (1961), and references cited therein, or methods analogous thereto can be used.

A typical example of the syntheses is illustrated below.

Synthesis Example 1

Synthesis of Coupler (9)

Coupler (9) is synthesized in accordance with the following reaction scheme:

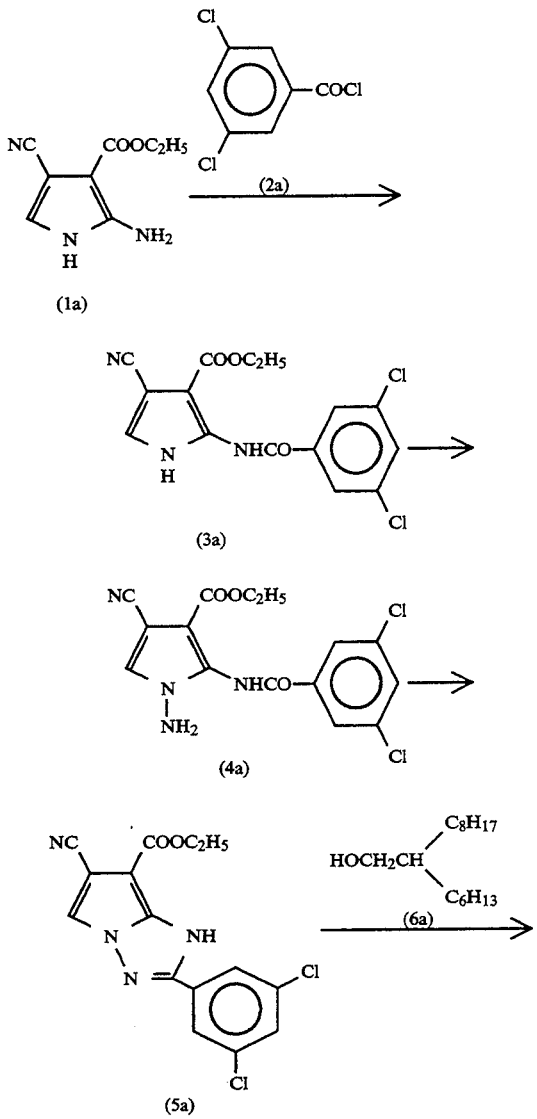

-continued

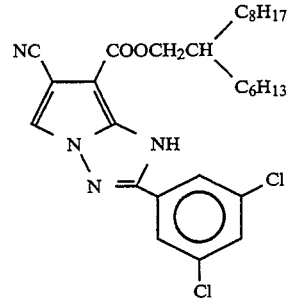

Coupler (9)

To a solution containing 2-amino-4-cyano-3-methoxycarbonylpyrrole (1a) (66.0 g, 0.4 mol) in dimelthylacetamide (300 ml), 3,5-dichlorobenzoyl chloride (2a) (83.2 g, 0.4 mol) is added, and stirred for 30 minutes. The reaction mixture is admixed with water, and the product is extracted in two steps with ethyl acetate. The organic layers are collected, washed successively with water and saturated brine, and dried over anhydrous sodium sulfate. Therefrom, the solvent is distilled away under reduced pressure, and the residue is recrystallized from acetonitrile (300 ml). Thus, the compound (3a) (113 g, 84% yield) is obtained.

The compound (3a) (101.1 g, 0.3 mol) is dissolved in dimethylformamide (200 ml), and admixed thoroughly with potassium hydroxide powder (252 g, 4.5 mol) at room temperature with stirring. To the mixture cooled with flowing water, hydroxylamine-o-sulfonic acid (237 g, 2.1 mol) is added little by little with care to avoid a sharp increase in the temperature. After the addition, the resulting mixture is stirred for 30 minutes. The reaction mixture is neutralized by dropping thereinto a 0.1N aqueous solution of hydrochloric acid as the pH thereof is checked with pH test paper. Therefrom, the reaction product is extracted in three steps with ethyl acetate. The organic layer obtained is washed successively with water and saturated brine, and dried over anhydrous sodium sulfate. The solvent is distilled away under reduced pressure, and the residue is purified by column chromatography (developing solvent: hexane/ethyl acetate=2/1). Thus, the compound (4a) (9.50 g, 9% yield) is obtained.

To a solution containing the compound (4a) (7.04 g, 20 mmol) in acetonitrile (30 ml) are added carbon tetrachloride (9 ml) and triphenylphosphine (5.76 g, 22 mmol) in succession at room temperature. The resulting solution is heated for 8 hours under reflux. After cooling, the reaction product is extracted in three steps with ethyl acetate. The organic layer obtained is washed successively with water and saturated brine, and dried over anhydrous sodium sulfate. The solvent is distilled away under reduced pressure, and the residue is purified by silica gel column chromatography (developing solvent: hexane/ethyl acetate=4/1). Thus, the compound (5a) (1.13 g, 17% yield) is obtained.

The compound (5a) (1.8 g) and the compound (6a) (12.4 g) are dissolved in sulforan (2.0 ml), and thereto is added titanium isopropoxide (1.5 g). The reaction is run for 1.5 hours as the temperature of the reaction system is kept at 110° C. Then, the reaction mixture is admixed with ethyl acetate, and washed with water. After the ethyl acetate layer is dried, the solvent is distilled away and the residue is purified by column chromatography.

Thus, the intended compound, Coupler (9), (1.6 g) is obtained. m.pt. 97°-98° C.

In using the present cyancouplers of general formula (Ia) in a silver halide color photosensitive material, it can answer the purpose to coat on a support at least one layer containing said cyan coupler, and the layer containing the cyan coupler may be any hydrophilic colloid layer provided on the support. A general color sensitive material is made up by providing on a support at least one blue-sensitive silver halide emulsion layer, at least one green-sensitive silver halide emulsion layer and at least one red-sensitive silver halide emulsion layer, in this order. However, these emulsion layers may be arranged in another order. Moreover, an infrared-sensitive silver halide emulsion layer can be substituted for at least one among the foregoing color-sensitive emulsion layers. These sensitive emulsion layers can reproduce colors in accordance with the color subtractive process by incorporating therein silver halide emulsions having sensitivities in their individual wavelength regions and couplers capable of forming dyes which bear a complementary color relationship to colored lights to which the corresponding emulsions are sensitive respectively. However, the photosensitive material may be designed so as not to have the above-described relationship between each sensitive emulsion layer and hue of the dye formed from the coupler incorporated therein.

In using the present cyan couplers of general formula (Ia) in a photosensitive material, it is especially desirable for said couplers to be incorporated in a red-sensitive silver halide emulsion layer.

The amount of the present cyan couplers used in a photosensitive material ranges preferably from 0.05 to 2.0 millimole/$m^2$, much preferably from 0.1 to 1.0 millimole/$m^2$, on a coverage basis, while it ranges preferably from $1\times10^{-3}$ to 1 mole, much preferably from $2\times10^{-3}$ to $5\times10^{-1}$ mole, per mole of silver.

Two or more of the present cyan couplers may be used together, and other cyan couplers can also be used together with the present couplers, provided that they do not lessen the effect of the present invention.

In the latter case, other cyan couplers are used in a proportion of 50 mole % or less, preferably 30 mole % or less, to the present couplers.

The high boiling organic solvents used in combination with the present cyan couplers of general formula (Ia) have a dielectric constant of at most 6.0 (measured at 25° C. and 10 KHz). The dielectric constant can be determined easily by the transformer bridge method (through a measurement with, e.g., TRS-10T, made by Ando Denki K. K.). In case a high boiling organic solvent takes a solid form at 25° C., the dielectric constant thereof is measured in a supercooled state, namely in a liquid state. When the groups represented by $R_5$ and $R_6$ in the foregoing formula (S) have a substituent, the substituent may contain therein one or more of a linkage group selected from a class consisting of —COO—, —CON= and —$R_{12}$—N=, wherein $R_{12}$ represents a di- to hexavalent group formed by removing hydrogen atom(s) from phenyl group.

In general formula (S), the alkyl groups represented by $R_5$ and $R_6$ may have a straight-chain structure or a branched chain structure. For instance, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl and so on are examples thereof.

As for the substituent which the above-cited alkyl groups may have, examples thereof include a halogen atom, a cycloalkyl group, an aryl group and an ester group. Specifically, the substituted alkyl groups described above are those substituted by halogen atom(s) (F, Cl, Br) (e.g., —$C_2HF_4$, —$C_5H_3F_8$, —$C_9H_3F_{16}$, —$C_2H_4Cl$, —$C_3H_4Cl_3$, —$C_3H_5Cl_2$, —$C_3H_5ClBr$, —$C_3H_5Br_2$), those substituted by a cycloalkyl group (e.g., —$CH_2$— 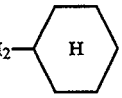 ), those substituted by an aryl group (e.g., —$CH_2$— 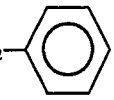 , —$CH_2CH_2$— 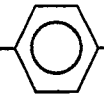 —Cl, —$CH_2$— 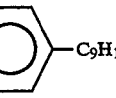 —$C_9H_{19}$), groups which provide dibasic acid esters (e.g., —$CH_2COOCH_2$— 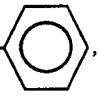 , —$CH_2CH_2COOC_{12}H_{25}$, —$(CH_2)_4COOCH_2(CF_2CF_2)_2H$, —$(CH_2)_7COOC_4H_9$, —$(CH_2)_8COOC_4H_9$), groups which provide lactic acid esters or the like (e.g., —CH—$CH_3$ 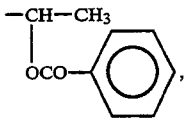 , —CH—$CH_3$ 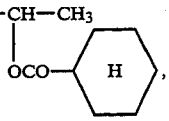 , —CH— 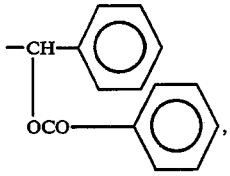 , —CH—$CH_3$ OH ), groups which provide citric acid esters or the like (e.g., —$CH_2$—C(OCOCH$_3$)(COOC$_4$H$_9$)—$CH_2COOC_4H_9$,

—$CH_2$—C(OCOCH$_3$)(COOCH$_2$CH(C$_2$H$_5$)C$_4$H$_9$)—$CH_2COOCH_2CHC_4H_9$), groups which provide malic acid esters or the like (e.g., —$CH_2CH(OH)COOC_6H_{13}$), groups which provide tartaric acid esters or the like (e.g., $-CH(OH)CH(OH)COOC_8H_{17}$, $$-\underset{\underset{OCOCH_3}{|}}{CH}\underset{\underset{OCOCH_3}{|}}{CH}COOC_4H_9),$$

$$-CH_2\underset{\underset{COOC_8H_{17}}{|}}{C}(OH)CH_2COOC_8H_{17}, \text{ and so on.}$$

Cycloalkyl groups represented by $R_5$ and $R_6$ include, e.g.,

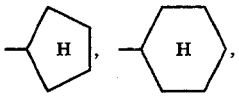

etc., and substituted cycloalkyl groups represented thereby include, e.g.,

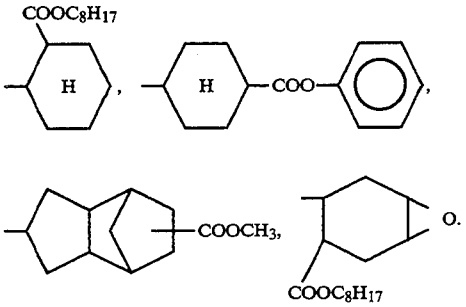

Aryl groups represented by $R_5$ and $R_6$ include, e.g.,

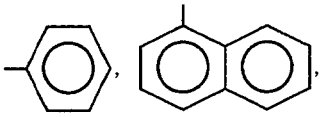

etc., and substituted aryl groups represented thereby are, e.g., groups which provide esters of phthalic acid, isophthalic acid, terephthalic acid, trimellitic acid or like acids, such as

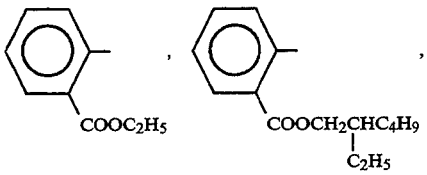

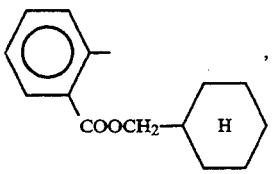

-continued

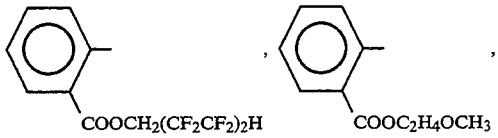

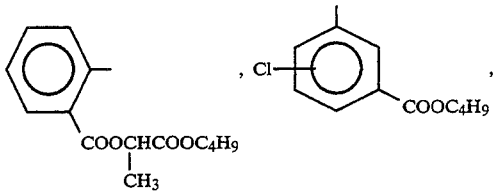

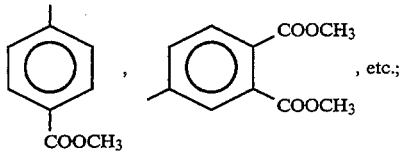

groups which provide substituted benzoic acid esters, such as

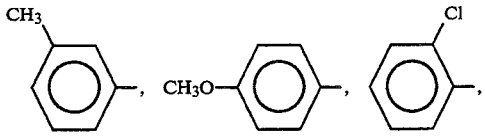

etc.; and so on.

Alkenyl groups represented by $R_5$ and $R_6$ include, e.g., $-C_4H_7$, $-C_5H_9$, $-C_6H_{11}$, $-C_7H_{13}$, $-C_8H_{15}$, $-C_{10}H_{19}$, $-C_{12}H_{23}$, $-C_{18}H_{35}$, etc., and substituted alkenyl groups represented thereby include, e.g., those substituted by halogen atoms (F, Cl, Br), $-OC_8H_{17}$, $-OC_{12}H_{25}$,

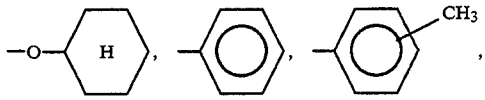

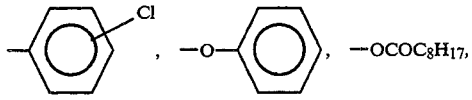

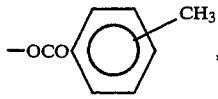

$-OCOC_8H_{17}$, $-C_8H_{15}$, $-C_{12}H_{23}$, or the like;

$$-CH{=}CH-COOCH_2\overset{\overset{C_2H_5}{|}}{C}HC_4H_9;$$

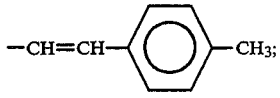

and so on.

The term high boiling organic solvents as used herein are intended to include those having a boiling point higher than about 150° C., preferably no lower than 170° C., under ordinary pressure. Additionally, such solvents should not be construed as being limited to those which are in a liquid state at room temperature, but they may include those which are in any state at room temperature, e.g., in a state of crystal having a low melting point, amorphous solid, paste, etc. When such a solvent takes a crystalline form at room temperature, it is desirable that the melting point thereof be not higher than 100° C., preferably not higher than 80° C.

A preferred ratio of the present high boiling organic solvent of general formula (S) to the present cyan coupler of general formula (Ia) ranges from 2 to 10 by weight. Also, the organic solvents of the present invention can be used as a mixture of two or more thereof, or a mixture with high boiling organic solvent(s) other than present ones, as far as the mixture can effect the objects of the present invention. Examples of other usable high boiling organic solvents include phosphate type solvents such as tricresyl phosphate, tri-2-ethylhexyl phosphate, 7-methyloctyl phosphate, tricyclohexyl phosphate, etc., phenol type solvents such as 2,5-di-tert-amylphenol, 2,5-di-sec-amylphenol, etc., phthalate type solvents such as dibutyl phthalate, dioctyl phthalate, etc., and so on.

Specific examples of the high boiling organic solvent represented by general formula (S) are illustrated below. However, the invention should not be construed as being limited to these examples. Additionally, the superscript EH of the octyl group contained in some of the compounds illustrated below means that an ethyl group branches off from the main chain of the group.

| Solvent of Formula (S) | Chemical Structure | Dielectric Constant (25° C., 10 KHz) |
|---|---|---|
| S-1 | 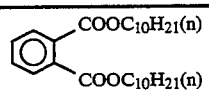 | 4.39 |
| S-2 | 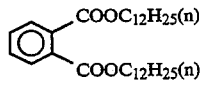 | 4.17 |
| S-3 | 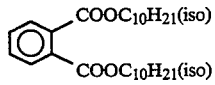 | 4.44 |
| S-4 | 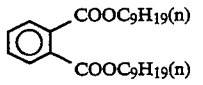 | 4.70 |
| S-5 | 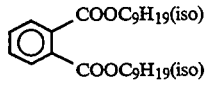 | 4.62 |
| S-6 | 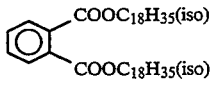 | 3.70 |
| S-7 | 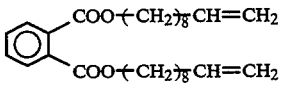 | 4.44 |
| S-8 | 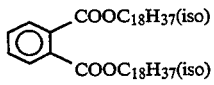 | 3.61 |
| S-9 | 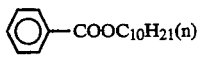 | 4.11 |
| S-10 | 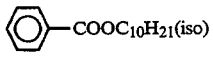 | 4.10 |
| S-11 | 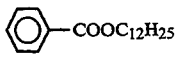 | 3.92 |
| S-12 | 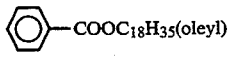 | 3.66 |
| S-13 | 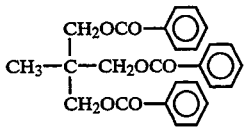 | 4.99 |

-continued

| Solvent of Formula (S) | Chemical Structure | Dielectric Constant (25° C., 10 KHz) |
|---|---|---|
| S-14 | $CH-COOC_9H_{19}(iso)$ ‖ $CH-COOC_9H_{19}(iso)$ | 4.38 |
| S-15 | $CH-COOC_8H_{17}^{EH}$ ‖ $CH-COOCH_2-(CF_2CF_2)_3H$ | 5.60 |
| S-16 | $CH_2=C-COOCH_2CH(C_4H_9)(C_2H_5)$ / $CH_2COOCH_2CH(C_4H_9)(C_2H_5)$ | 4.63 |
| S-17 | $C_8H_{17}O-C(=O)-O-C_8H_{17}$ | 2.38 |
| S-18 | $C_6H_5-CH_2OCOCH_3$ | 5.31 |
| S-19 | $C_6H_5-CH_2OCOC_2H_5$ | 4.92 |
| S-20 | $C_6H_5-CH_2OCOC_5H_{11}$ | 4.24 |
| S-21 | $C_6H_5-CH_2OCOC_7H_{15}$ | 3.97 |
| S-22 | $C_6H_5-CH_2OCOC_{11}H_{23}$ | 3.62 |
| S-23 | $C_2H_5C(CH_2OCOC_9H_{19})_3$ | 3.26 |
| S-24 | $CH_2COO-C_4H_9$ / $CHCOO-C_4H_9$ / $CH_2COO-C_4H_9$ | 5.19 |
| S-25 | $C_6H_8(COOCH_2CH(C_4H_9)(C_2H_5))_2$ | 4.34 |
| S-26 | $C_4H_9CH(C_2H_5)COOCH_2C(CH_3)(CH_3)CH_2OCOCH(C_2H_5)C_4H_9$ | 3.54 |
| S-27 | $C_8H_{17}-CH-CH-(CH_2)_7COOC_8H_7$ (epoxide O) | 4.35 |
| S-28 | $C_6H_8O(COOC_8H_{17})_2$ | 5.37 |

-continued

| Solvent of Formula (S) | Chemical Structure | Dielectric Constant (25° C., 10 KHz) |
|---|---|---|
| S-29 | $(CH_2)_8$(COOC$_4$H$_9$)$_2$ | 4.45 |
| S-30 | $(CH_2)_8$(COOC$_8$H$_{17}^{EH}$)$_2$ | 3.96 |
| S-31 | H(COOC$_8$H$_{17}^{EH}$)$_2$ | 4.43 |
| S-32 | $C_{13}H_{27}COOCH_2CH(C_6H_{13})C_8H_{17}$ | 2.89 |
| S-33 | HO—C(CH$_2$COOC$_7$H$_{15}$)$_3$ | 5.37 |
| S-34 | HO—C(CH$_2$COOC$_8$H$_{17}^{EH}$)$_3$ | 5.39 |
| S-35 | HO—C(CH$_2$COOC$_{10}$H$_{21}$)$_3$ | 4.83 |
| S-36 | COOC$_{18}$H$_{37}$(iso)—CHOH—CHOH—COOC$_{18}$H$_{37}$(iso) | 3.75 |
| S-37 | CH$_3$—CH(OCO—C$_6$H$_5$)—COOC$_8$H$_{17}^{EH}$ | 5.72 |
| S-38 | CH$_3$—CH(OCO—C$_6$H$_5$)—COOC$_{18}$H$_{37}$(iso) | 4.29 |
| S-39 | CH$_3$COO—C(CH$_2$COOC$_8$H$_{17}^{EH}$)$_3$ | 4.66 |
| S-40 | Cl—C$_6$H$_4$—COOC$_8$H$_{17}$(n) | 4.11 |
| S-41 | Cl—C$_6$H$_4$—COOC$_{12}$H$_{25}$ | 4.11 |
| S-42 | CH$_3$O—C$_6$H$_4$—COOC$_8$H$_{17}$ | 5.90 |

-continued

| Solvent of Formula (S) | Chemical Structure | Dielectric Constant (25° C., 10 KHz) |
|---|---|---|
| S-43 | 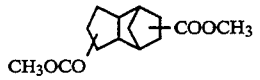 | 5.46 |

The magenta couplers of general formula (II) are described below in detail.

As for the substituent group represented by $R_7$ in general formula (II) and the substituent which the substituted methine groups represented by Zd, Ze and Zf can have in general formula (II), an alkyl group, an alkoxy group, an aryl group, an aryloxy group and those formed by attaching some substituent(s) to these groups are representative examples thereof. Details of these substituent groups are described in U.S. Pat. No. 4,540,654, from column 2, 41st line, to column 8, 27th line.

As for the coupling-eliminable group represented by Y, a halogen atom and a group of the type which contains a sulfur, oxygen or nitrogen atom at which the elimination occurs are suitable examples thereof. In particular, a halogen atom and an arylthio group are preferred over others.

It is desirable that either of the Zd—Ze or the Ze—Zf bond be a double bond, and the other be a single bond. When the Ze—Zf bond is a C—C double bond, it may constitute a part of an aromatic ring.

Among the pyrazoloazole type couplers represented by general formula (II), the imidazo[1,2-b]pyrazoles disclosed in U.S. Pat. No. 4,500,630 are preferred in view of the low yellow side absorption of the developed dyes and light fastness thereof, and the pyrazolo[1,5-b][1,2,4]triazoles disclosed in U.S. Pat. No. 4,540,654 are especially favored in that regard.

In addition, there can be preferably employed pyrazolotriazole type couplers in which the 2-, 3- or 6-position of the pyrazolotriazole ring is substituted by a branched alkyl group, as disclosed in JP-A-61-65245; pyrazoloazole type couplers which contain a sulfoamido group in a molecule, as disclosed in JP-A-61-65246; pyrazoloazole type couplers which contain an alkoxyphenylsulfonamido group as a ballast group, as disclosed in JP-A-61-147254; and pyrazolotriazole type couplers in which the 6-position is substituted by an alkoxy or aryloxy group, as disclosed in European Patents (laid open) 226,849 and 294,785.

Specific examples of the magenta couplers represented by general formula (II) which can be preferably used in the present invention are illustrated below, but the invention should not be construed as being limited to these examples:

| Compound | $R_{10}$ | $R_{11}$ | Y |
|---|---|---|---|
| | | 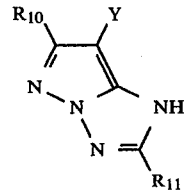 | |
| II-1 | $CH_3$— | 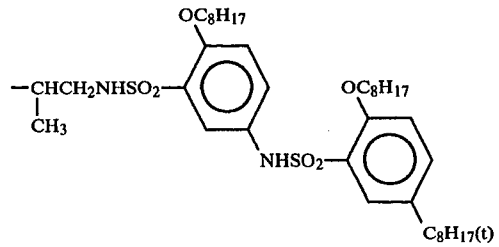 | Cl |
| II-2 | " | 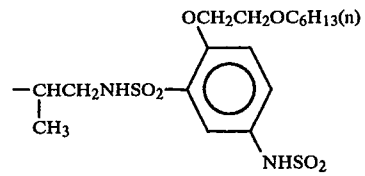 | " |
| II-3 | $(CH_3)_3C$— | 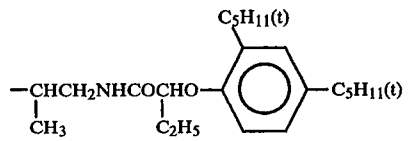 | 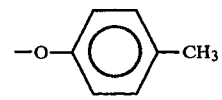 |
| II-4 | 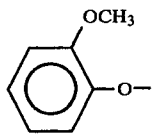 | 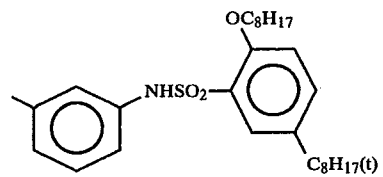 | 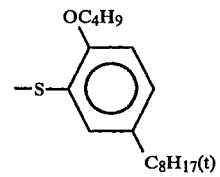 |

-continued
| Compound | $R_{10}$ | $R_{11}$ | Y |
|---|---|---|---|
| II-5 | $CH_3$— | 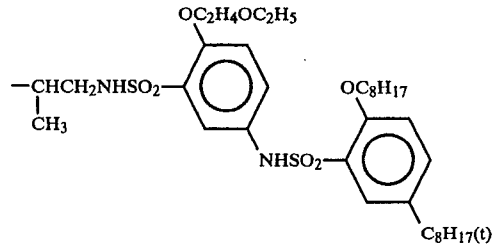 | Cl |
| II-6 | " | 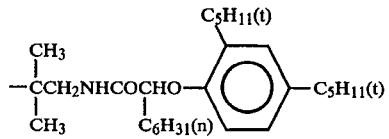 | " |
| II-7 | " | 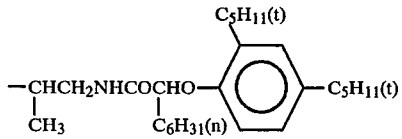 | " |
| II-8 | $CH_3$— | 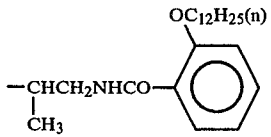 | Cl |
| II-9 | " | 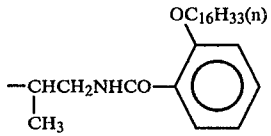 | " |

-continued
| Compound | $R_{10}$ | $R_{11}$ | Y |
|---|---|---|---|
| II-10 | 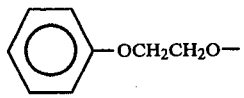 | 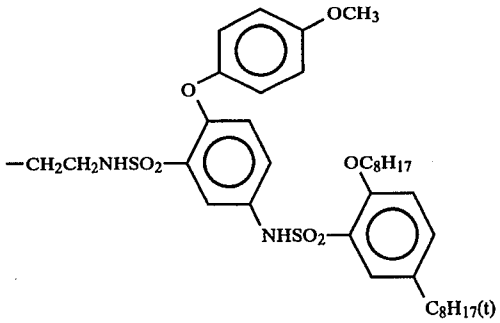 | 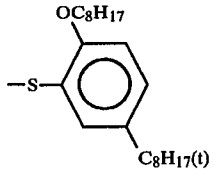 |
| II-11 | $CH_3CH_2O$— | " | " |
| II-12 | 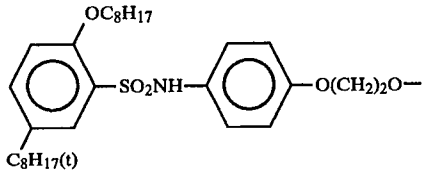 | 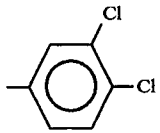 | 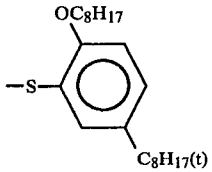 |
| II-13 | 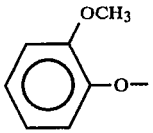 | 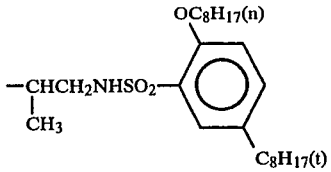 | Cl |
| II-14 | $(CH_3)_3C$— | 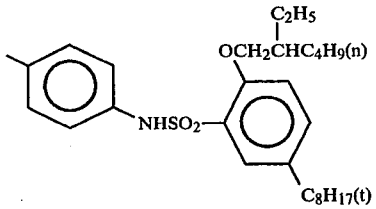 | Cl |

-continued
| Compound | $R_{10}$ | $R_{11}$ | Y |
|---|---|---|---|
| | | 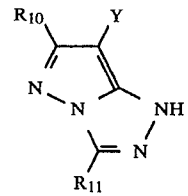 | |
| II-15 | $CH_3$— | 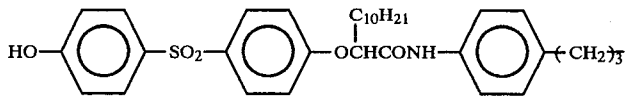 | Cl |
| II-16 | " | 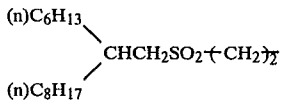 | " |
| II-17 | 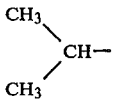 | 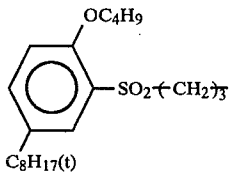 | " |
| II-18 | 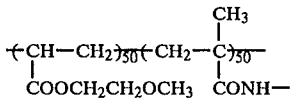 | 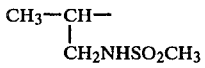 | " |
| II-19 | 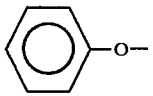 | 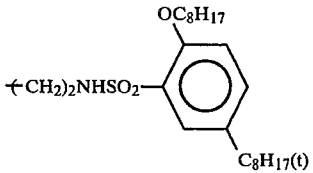 | Cl |

-continued
| Compound | $R_{10}$ | $R_{11}$ | Y |
|---|---|---|---|
| II-20 | $CH_3$— | 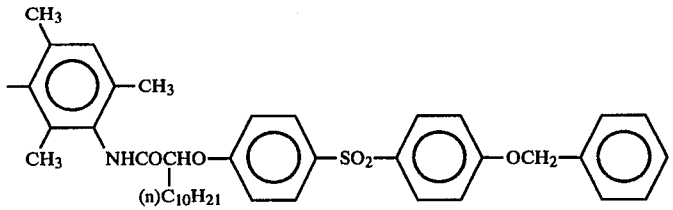 | " |
| II-21 | $(CH_3)_3C$— | 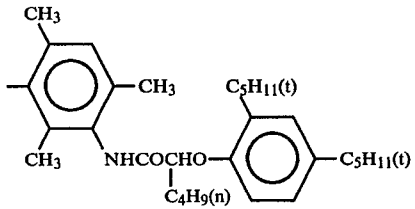 | " |
| II-22 | 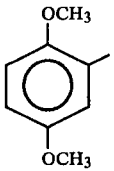 | 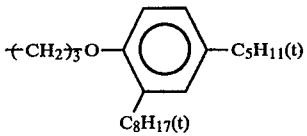 | Cl |
| II-23 | $CH_3$— | $-CH(C_2H_5)-N(n)C_{18}H_{37}COCH_2CH_2COOH$ | " |
| II-24 | $(CH_3)_3C$— | $-(CH_2)_3SO_2C_{12}H_{25}$ | " |

Additionally, the couplers of general formula (II) can be synthesized by reference to Parkin, *Journal of the Chemical Society*, I (1977), 2047-2052; U.S. Pat. No. 3,725,067; JP-A-59-99437; JP-A-58-42045; JP-A-59-162548; JP-A-59-171956; JP-A-60-33552; JP-A-60-43659; JP-A-60-172982; JP-A-60-190779; and so on.

The present magenta coupler of general formula (II) can be used at a coverage of 0 05 to 2 0 millimole/$m^2$, preferably 0.1 to 1.0 millumole/$m^2$. On the other hand, the amount of said coupler used per mole of silver halide ranges generally from $1\times10^{-3}$ to 1 mole, preferably from $1\times10^{-2}$ to $8\times10^{-1}$ mole.

Also, the present magenta couplers may be used as a mixture of two or more thereof, and can be used together with other magenta couplers, provided that they do not lessen the effect of the present invention. In the latter case, the proportion of other magenta couplers to the present magenta couplers is not greater than 50 mole %, preferably not greater than 30 mole %.

Into the silver halide emulsion layer which contains the present magenta coupler, various kinds of hydroquinone compounds may be additionally incorporated for the purpose of gradation control and prevention of fog generation. The amount of such compounds added is preferably not greater than $2\times10^{-2}$ mole, much preferably not greater than $5\times10^{-3}$ mole, per mole of silver. However, it is most desirable for the achievement of the present objects that the foregoing emulsion layer be free from such compounds.

Silver halides which can be used in the present invention are silver chloride, silver bromide, silver (iodo)-chlorobromide, silver iodobromide and so on. In particular, it is desirable for rapid processing to use a substantially iodide-free silver chlorobromide emulsion having a chloride content of at least 90 mole %, preferably at least 95 mole %, and particularly preferably at least 98 mole %, or silver chloride emulsion.

For the purpose of enhancement of image sharpness and the like, it is desirable to add dyes capable of undergoing decolorization by photographic processing (especially oxonol dyes), which are disclosed at pages 27 to 76 in EP-A2-0337490, to a hydrophilic colloid layer of the present photosensitive material in such an amount as to impart an optical reflection density of at least 0.70 at 680 nm to the resulting photosensitive material, and to incorporate titanium oxide grains which have undergone surface treatment with a di- to tetrahydric alcohol (e.g., trimethylolethane) or the like in a content of at least 12 wt % (preferably at least 14 wt %) into a waterproof resin layer which constitutes the support of the present photosensitive material.

High boiling organic solvents which can be used for photographic additives, including magenta and yellow couplers capable of using in the present invention, are water-immiscible compounds which not only have a melting point of 100° C. or lower and a boiling point of 140° C. or higher but also are good solvents for couplers. The melting point of desirable high boiling organic solvents is 80° C. or lower and the boiling point thereof is 160° C. or higher, preferably 170° C. or higher.

Details of such high boiling organic solvents are described in JP-A-62-215272, from the right lower column at page 137 to the right upper column at page 144.

On the other hand, a loadable latex polymer (as disclosed, e.g., in U.S. Pat. No. 4,203,716) impregnated with a cyan, magenta or yellow coupler in the presence (or absence) of a high boiling organic solvent as described above, or such a coupler dissolved in a polymer insoluble in water but soluble in an organic solvent in the presence (or absence) of a high boiling organic solvent, can be dispersed into a hydrophilic colloid solution in an emulsified condition.

Polymers which can be preferably used therein include the homo- or copolymers disclosed in U.S. Pat. No. 4,857,449, from column 7 to column 15, and WO 88/00723, from page 12 to page 30. Much preferably, polymers of methacrylate or acrylamide type, especially those of acrylamide type, are favored over others with respect to color image stabilization and so on.

In addition, it is desirable that compounds for improving the keeping quality of dye images, such as those disclosed in EP-A2-0277589, be used together with the couplers in the photosensitive material of the present invention. In particular, the combined use of such compounds and pyrazoloazole couplers or the present pyrrolotriazole couplers is preferred.

That is, compounds of the kind which can produce chemically inert, substantially colorless compounds by combining chemically with an aromatic amine developing agent remaining after the color development-processing (Compound F) and/or compounds of the kind which can produce chemically inert, substantially colorless compounds by combining chemically with the oxidized aromatic amine developing agent remaining after the color development-processing (Compound G) are preferably used in combination or independently. By the use of these compounds, the generation of stain, which is due to the formation of dyes through the reaction between the couplers and the unoxidized or oxidized color developing agent remaining in the processed photographic film, and the occurrence of other side reactions upon storage after photographic processing, can be inhibited effectively.

Also, it is desirable that the antimolds disclosed, e.g., in JP-A-63-271247 be added to the photosensitive material of the present invention in order to prevent the deterioration of images from occurring through propagation of various kinds of molds and bacteria in the hydrophilic colloid layers.

As for the support of the present photosensitive material, a support of the white polyester type or a support provided with a white pigment-containing layer on the same side as the silver halide emulsion layers may be adopted for display use. Further, it is desirable for improving sharpness that an antihalation layer be provided on the emulsion layer side or the reverse side of the support. In particular, it is preferable that the transmission density of the support be adjusted to the range of 0.35 to 0.8 so that a display may be enjoyed by means of both transmitted and reflected rays of light.

The photosensitive material of the present invention may be exposed to either visible or infrared rays. For the exposure, not only low intensity exposure but also high intensity short-time exposure may be employed. However, short-time exposure systems in which the exposure time per picture element is shorter than $10^{-3}$ second are preferable for the present invention. In particular, a laser scanning exposure system in which the exposure time per picture element is shorter than $10^{-4}$ second is preferred over others.

Upon exposure, it is advantageous to use the band stop filter disclosed in U.S. Pat. No. 4,880,726. This filter can get rid of color stain of optical origin to improve color reproducibility to a great extent.

The optically exposed photosensitive material can be subjected to conventional color photographic processing. In order to effect rapid processing, however, it is advantageous to the photosensitive material to undergo a bleach-fix operation after a color-development operation. In a special case such that emulsions having a high chloride content as described hereinbefore are used, it is desirable for accelerating the desilvering speed that the pH of a bleach-fix bath be not higher than about 6.5, preferably not higher than about 6.

Silver halide emulsions, other ingredients (such as additives, etc.) and photographic constituent layers (including their order of arrangement) which can be preferably used in the present photosensitive materials, and photographic processing methods and additives for photographic processing which can be preferably employed for processing the present photosensitive material are those disclosed in the following patent specifications, especially in EP-A2-0355660 (corresponding to JP-A-02-139544).

| Photographic Constituents and Related Matters | JP-A-62-215272 | JP-A-02-33144 | EP-A2-0355660 |
|---|---|---|---|
| Silver halide emulsion | from 6th line in right upper column at page 10 to 5th line in left lower column at page 12, and from 4th line from the bottom of right lower column at page 12 to 17th line in left upper column at page 13 | from 16th line in right upper column at page 28 to 11th line in right lower column at page 29, and from 2nd line to 5th line at page 30 | from 53rd line at page 45 to 3rd line at page 47, and from 20th line to 22nd line at page 47 |
| Silver halide solvents | from 6th line to 14th line in left lower column at page 12, and from 3rd line from the bottom of left upper column at page 13 to the end line in left lower column at page 18 | — | — |
| Chemical sensitizers | from 3rd line from the bottom of left lower column to 5th line from the bottom of right lower column at page 12, and from 1st line in right lower column at page 18 to 9th line from the bottom of right upper column at page 22 | from 12 line to end line in right lower column at page 29 | from 4th line to 9th line at page 47 |
| Spectral sensitizers (including spectral sensitization methods) | from 8th line from the bottom of right upper column at page 22 to end line at page 38 | from 1st to 13th in left upper column at page 30 | from 10th line to 15th line at page 47 |
| Emulsion stabilizers | from 1st line in left upper column at page 39 to end line in right upper column at page 72 | from 14th line in left upper column to 1st line in right upper column at page 30 | from 16th line to 19th line at page 47 |
| Development accelerators | from 1st line in left lower column at page 72 to 3rd line in right upper column at page 91 | — | — |
| Color couplers (cyan, magenta and yellow couplers) | from 4th line in right upper column at page 91 to 6th line in left upper column at page 121 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th line to 31st line at page 45, and from 23rd line at page 47 to 50th line at page 63 |
| Color formation reinforcing agent | from 7th line in left upper column at page 121 to 1st line in right upper column at page 125 | — | — |
| Ultraviolet absorbents | from 2nd line in right upper column at page 125 to end line in left lower column at page 127 | from 14th line in right lower column at page 37 to 11th line in left upper column at page 38 | from 22nd line to 31st line at page 65 |
| Discoloration inhibitors (image stabilizers) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 29 to 25th line at page 45 from 33rd line to 40th line at page 45, and from 2nd line to 21st line at page 65 |
| High boiling and/or low boiling organic solvents | from 9th line in left lower column at page 137 to end line in right upper column at page 144 | from 14th line in right lower column at page 35 to 4th line from the bottom of left upper column at page 36 | from 1st line to 51st line at page 64 |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 36 | from 51st line at page 63 to 56th line at page 64 |
| Hardeners | from 8th line in right upper column at page 146 to 4th line in left lower column at | — | — |

-continued

| Photographic Constituents and Related Matters | JP-A-62-215272 | JP-A-02-33144 | EP-A2-0355660 |
|---|---|---|---|
| | page 155 | | |
| Precursors of developing agent | from 5th line in left lower column to 2nd line in right lower column at page 155 | — | — |
| Development inhibitor releasing compounds | from 3rd line to 9th line in right lower column at page 155 | — | — |
| Supports | from 19th line in right lower column at page 155 to 14th line in left upper column at page 156 | from 18th line in right upper column at page 38 to 3rd line in left upper column at page 39 | from 29th line at page 66 to 13th line at page 67 |
| Light-sensitive layer constitution | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color stain inhibitors | from 1st line in left upper column at page 185 to 3rd line in right lower column at page 188 | from 8th line to 11th line in right upper column at page 36 | from 57th line at page 64 to 1st line at page 65 |
| Tone modifiers | from 4th line to 8th line in right lower column at page 188 | — | — |
| Stain inhibitors | from 9th line in right lower column at page 188 to 10th line in right lower column at page 193 | from end line in left upper column to 13th line in right lower column at page 37 | from 32nd line at page 65 to 17th line at page 66 |
| Surfactants | from 1st line in left lower column at page 201 to end line in right upper column at page 210 | from 1st line in right upper column at page 18 to end line in right lower column at page 24, and from 10th line from the bottom of left lower column to 9th line in right lower column at page 27 | — |
| Fluorine-containing compounds (antistatic agent, coating aids, lubricants, adhesion inhibitors, etc.) | from 1st line in left lower column at page 210 to 5th line in left lower column at page 222 | from 1st line in left upper column at page 25 to 9th line in right lower column at page 27 | — |
| Binders (hydrophilic colloids) | from 6th line in left lower column at page 222 to end line in left upper column at page 225 | from 8th line to 18th line in right upper column at page 38 | from 23rd line to 28th line at page 66 |
| Thickening agent | from 1st line in right upper column at page 225 to 2nd line in right upper column at page 227 | — | — |
| Antistatic agent | from 3rd line in right upper column at page 227 to 1st line in left upper column at page 230 | — | — |
| Polymer latexes | from 2nd line in left upper column at page 230 to end line at page 239 | — | — |
| Matting agent | from 1st line in left upper column to end line in right upper column at page 240 | — | — |
| Photographic processing methods (including processing steps, additives, and so on) | from 7th line in right upper column at page 3 to 5th line in right upper column at page 10 | from 4th line in left upper column at page 39 to end line in left upper column at page 42 | from 14th line at page 67 to 28th line at page 69 |

Note) The quoted paragraphs of JP-A-62-21527 are intended to include the contents of amendments date March 16 in 1987 which were given in the end of the bulletin.

As for the yellow coupler among the above-cited color couplers, the so-called blue-shift couplers disclosed in JP-A-63-231451, JP-A-63-123047, JP-A-63-241547, JP-A-01-173499, JP-A-01-213648 and JP-A-01-250944 are preferably used in addition to those cited in the above references. Much preferably, the yellow couplers of cycloalkane series acylacetanilide type disclosed in JP-A-04-116643 and the yellow couplers of indolinoacetanilide type disclosed in JP-A-02-286341 are used.

As for the cyan coupler, on the other hand, not only diphenylimidazole type can couplers disclosed in JP-A-02-33144 but also 3-hydroxypyridine type cyan couplers disclosed in EP-A2-0333185 (especially one which is prepared by introducing a chlorine atom as a splitting-off group into Coupler (42) cited as a specific example to render the coupler two-equivalent, and Couplers (6) and (9) cited as specific examples) and cyclic active methylene type cyan couplers disclosed in JP-A-64-32260 (especially Couplers 3, 8 and 34 cited as specific examples) may be used together with the present cyan couplers.

In processing silver halide color photosensitive materials in which silver halide emulsions having a high chloride content of at least 90 mole % are used, the method disclosed in JP-A-02-207250, from left upper column at page 27 to right upper column at page 34, are preferably employed.

The present invention will now be illustrated in more detail by reference to the following examples.

EXAMPLE 1

An undercoated triacetyl cellulose support was coated with compositions for constituent layers described below to prepare a monocolor photosensitive material for evaluation purpose (Sample 101).

Preparation of Coating Composition for Emulsion Layer

To 1.0 g of a coupler (Coupler ExC-1 illustrated below) were added 10 ml of ethyl acetate and 0.5 g of a high boiling organic solvent to prepare a coupler solution. The coupler solution was dispersed in an emulsified condition into 36 g of a 14% aqueous gelatin solution containing 4 ml of a 10% sodium dodecylbenzenesulfonate solution. On the other hand, a silver chlorobromide emulsion (bromide content: 70 mole %) which had undergone sulfur sensitization was prepared. The emulsion was mixed homogeneously with the foregoing emulsified dispersion in such a ratio as to have the composition described below. In addition, sodium salt of 1-oxy-3,5-dichloro-s-triazine was used therein as hardener.

Layer Structure

The composition of each constituent layer is described below. (Each figure on the right side represents the coverage of the ingredient corresponding thereto per $m^2$.)

Support:

Triacetyl cellulose support

| | |
|---|---|
| Emulsion Layer: | |
| Silver chlorobromide emulsion (described above) | 3.0 mmol |
| Coupler (ExC-1) | 0.50 g |
| High boiling organic solvent | 0.25 g |
| Gelatin | 5.2 g |
| Protective Layer: | |
| Gelatin | 1.3 g |
| Acryl-modified copolymer of polyvinyl alchol (modification degree: 17%) | 0.17 g |
| Liquid paraffin | 0.03 g |

Then, Samples 102 to 146 were prepared in the same manner as the foregoing Sample 101, except that the cyancoupler and the high boiling organic solvent used in Sample 101 was replaced by those shown in Table A. In the samples using the present cyan couplers, however, the coverage of each cyan coupler was reduced to one-half the coverage of ExC-1 used for comparison, namely 0.5 mmol/$m^2$, in order to adjust the density of developed color.

The structural formula of the Coupler (ExC-1) used herein for comparison is illustrated below:

ExC-1 (cyan coupler for comparison)

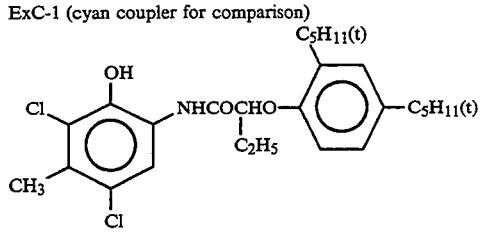

The thus prepared photosensitive materials were subjected to gradation exposure using an optical wedge, and then to the photographic processing constituted of the following processing steps:

| Processing Steps: | | |
|---|---|---|
| Processing Step | Temperature | Time |
| Color Development | 33° C. | 2 minutes |
| Bleach-Fix | 33° C. | 1.5 minutes |
| Washing | 33° C. | 3 minutes |

| Compositions of Processing Solutions: | |
|---|---|
| Color Developer: | |
| Distilled water | 800 ml |
| Triethanolamine | 8.1 g |
| Diethylhydroxylamine | 4.2 g |
| Potassium bromide | 0.6 g |
| Sodium hydrogen carbonate | 3.9 g |
| Sodium sulfite | 0.13 g |
| N-ethyl-N-(β-methanesulfonamidoethyl)-3-methyl-4-aminoaniline sulfate | 5.0 g |
| Potassium carbonte | 18.7 g |
| Water to make | 1,000 ml |
| pH adjusted to | 10.25 |
| Bleach-Fix Bath: | |
| Distilled water | 400 ml |
| Ammonium thiosulflate (700 g/l) | 150 ml |
| Sodium sulfate | 18.0 g |
| Ammonium ethylenediaminetetraacetate | 55.0 g |
| Sodium ethylenediaminetetraacetate | 5.0 g |
| Water to make | 1,000 ml |
| pH adjusted to | 6.70 |

The thus processed samples were examined for the maximum density of developed cyan color, Dmax. On the other hand, each sample which had been exposed so as to have the developed color density of 1.0 was subjected to the measurements via Blue filter and Green filter respectively, and the measured values were designated as Y-component and M-component respectively. These values signify that the smaller they are, the less side absorption the cyan absorption is attended by, that is to say, them ore satisfactorily cyan color is reproduced.

The results obtained are shown in Table A.

TABLE A

| | | High Boiling Organic Solvent | | | Hue | | |
|---|---|---|---|---|---|---|---|
| Sample | Coupler | Species | O/C ratio | Dmax | M-Component | Y-Component | note |
| 101 | ExC-1 | S-1 | 0.5 | 1.54 | 0.17 | 0.08 | comparison |
| 102 | " | " | 1.0 | 1.57 | 0.17 | 0.08 | " |
| 103 | " | " | 2.0 | 1.59 | 0.17 | 0.08 | " |
| 104 | " | " | 3.0 | 1.55 | 0.16 | 0.08 | " |
| 105 | " | S-9 | 0.5 | 1.50 | 0.18 | 0.08 | " |
| 106 | " | " | 1.0 | 1.55 | 0.17 | 0.08 | " |
| 107 | " | " | 3.0 | 1.56 | 0.17 | 0.08 | " |

TABLE A-continued

| Sample | Coupler | High Boiling Organic Solvent Species | O/C ratio | Dmax | Hue M-Component | Hue Y-Component | note |
|---|---|---|---|---|---|---|---|
| 108 | " | S-13 | 3.0 | 1.55 | 0.17 | 0.08 | " |
| 109 | " | S-21 | 3.0 | 1.47 | 0.17 | 0.08 | " |
| 110 | " | S-23 | 3.0 | 1.45 | 0.19 | 0.08 | " |
| 111 | " | S-25 | 3.0 | 1.57 | 0.17 | 0.08 | " |
| 112 | " | S-27 | 3.0 | 1.67 | 0.18 | 0.08 | " |
| 113 | " | S-28 | 3.0 | 1.58 | 0.18 | 0.08 | " |
| 114 | " | S-29 | 0.5 | 1.48 | 0.19 | 0.08 | " |
| 115 | " | " | 1.0 | 1.53 | 0.18 | 0.08 | " |
| 116 | " | " | 2.0 | 1.59 | 0.18 | 0.08 | " |
| 117 | " | " | 3.0 | 1.48 | 0.18 | 0.08 | " |
| 118 | " | S-32 | 3.0 | 1.58 | 0.18 | 0.08 | " |
| 119 | I-21 | S-1 | 0.5 | 1.89 | 0.18 | 0.04 | invention |
| 120 | " | " | 1.0 | 2.01 | 0.17 | 0.04 | " |
| 121 | " | " | 2.0 | 2.05 | 0.16 | 0.04 | " |
| 122 | " | " | 3.0 | 2.05 | 0.14 | 0.04 | " |
| 123 | I-21 | S-9 | 0.5 | 1.84 | 0.18 | 0.04 | invention |
| 124 | " | " | 1.0 | 2.01 | 0.16 | 0.04 | " |
| 125 | " | " | 3.0 | 2.06 | 0.14 | 0.04 | " |
| 126 | " | S-13 | 3.0 | 2.05 | 0.14 | 0.04 | " |
| 127 | " | S-21 | 3.0 | 2.06 | 0.14 | 0.04 | " |
| 128 | " | S-23 | 3.0 | 2.05 | 0.14 | 0.04 | " |
| 129 | " | S-25 | 3.0 | 2.05 | 0.14 | 0.04 | " |
| 130 | " | S-27 | 3.0 | 2.07 | 0.14 | 0.04 | " |
| 131 | " | S-28 | 3.0 | 2.07 | 0.14 | 0.04 | " |
| 132 | " | S-29 | 0.5 | 1.84 | 0.18 | 0.04 | " |
| 133 | " | " | 1.0 | 1.99 | 0.16 | 0.04 | " |
| 134 | " | " | 2.0 | 2.05 | 0.14 | 0.04 | " |
| 135 | " | " | 3.0 | 2.06 | 0.13 | 0.04 | " |
| 136 | " | S-32 | 3.0 | 2.07 | 0.13 | 0.04 | " |
| 137 | I-14 | S-1 | 3.0 | 2.04 | 0.13 | 0.04 | invention |
| 138 | " | S-9 | 3.0 | 2.05 | 0.13 | 0.04 | " |
| 139 | " | S-13 | 3.0 | 2.04 | 0.13 | 0.04 | " |
| 140 | " | S-21 | 3.0 | 2.03 | 0.14 | 0.04 | " |
| 141 | " | S-23 | 3.0 | 2.04 | 0.13 | 0.04 | " |
| 142 | " | S-25 | 3.0 | 2.04 | 0.13 | 0.04 | " |
| 143 | " | S-27 | 3.0 | 2.05 | 0.13 | 0.04 | " |
| 144 | " | S-28 | 3.0 | 2.06 | 0.13 | 0.04 | " |
| 145 | " | S-29 | 3.0 | 2.05 | 0.13 | 0.04 | " |
| 146 | " | S-32 | 3.0 | 2.06 | 0.13 | 0.04 | " |

The term "O/C ratio" used in Table A refers to the weight ratio of a high boiling organic solvent (0) to a cyan coupler (C).

From the data set forth in Table A, it has turned out that:

(1) although the present couplers were each used at the coverage reduced to one-half that of the coupler for comparison, the developed color densities were higher in all the samples using the present couplers than in the samples for comparison, irrespective of species of the high boiling organic solvent used together, (2) all the sensitive materials using the present couplers were less in both Y-component and M-component than the samples for comparison, that is, they were superior in hue to the samples for comparison, and (3) an improvement in hue with the increase in amount of the oil used was produced in case the present couplers were used, whereas such an improvement was not brought about in a substantial sense in case the couplersfor comparison were used..

EXAMPLE 2

The surface of a paper support laminated with polyethylene on both sides was subjected to corona discharge, and then provided with a gelatin subbing layer in which sodium dodecylbenzenesulfonate was incorporated. Thereon, various constituent layers described below were further coated to prepare a multilayer color photographic paper (Sample 201). Coating solutions used therein were prepared in the following manners.

A cyan coupler (ExC-1) in an amount of 30 g, 18.0 g of an ultraviolet absorbent (UV-2), 30 g of a color image stabilizer (Cpd-1), 1.0 g of a color image stabilizer (Cpd-9), 1.0 g of a color image stabilizer (Cpd-10), 1.0 g of a color image stabilizer (Cpd-11), 1.0 g of a color image stabilizer (Cpd-8), 1.0 g of a color image stabilizer (Cpd-6) and 15 g of a high boiling organic solvent (RS-1) were dissolved into 60 ml of ethyl acetate, then added to 50 ml of a 20% aqueous gelatin solution containing 8 ml of a solution of sodium dodecylbenzenesulfonate, and further dispersed thereinto in an emulsified condition by means of a high-speed rotary homogenizer to prepare an emulsified dispersion. On the other hand, there were prepared two kinds of silver chlorobromide emulsions, one of which comprised large-size grains having a cubic crystal shape, an average size of 0.50 μm and a variation coefficient of 0.09 with respect to grain size distribution (a large-sized Emulsion C), and the other of which comprised small-size grains having a cubic crystal shape, an average size of 0.41 μm and a variation coefficient of 0.11 with respect to grain size distribution (a small-sized Emulsion C), said large-sized and small-sized grains each being composed of 0.8 mol % of silver bromide which is localized in part of the grain surface and the remainder mol % of silver chloride. A red-sensitive sensitizing dye E illustrated below was added to the large-sized emulsion in an amount of $0.9\times10^{-4}$ mole/mole Ag and to the small-sized emulsion in an amount of $1.1\times10^{-4}$ mole/mole Ag. Then, the resulting large-sized and small-sized emulsions were mixed in a ratio of 1:4 on a silver basis to prepare a silver chlorobromide emulsion. Further, Compound F illustrated below was added to the silver chlorobromide emulsion in an amount of $2.6\times10^{-3}$ mole/mole Ag. Furthermore, the resulting emulsion was chemically ripened by adding thereto sulfur and gold sensitizers. The thus prepared red-sensitive silver chlorobromide emulsion and the foregoing emulsified dispersion were mixed homogeneously, and thereto were added other ingredients described below so as to obtain the coating solution for the fifth layer having the composition described below.

Coating solutions for layers other than the fifth layer were prepared in the same manner as that for the fifth layer. In each layer, sodium salt of 1-oxy-3,5-dichloro-s-triazine was used as gelatin hardener.

In addition, the following compounds (Cpd-14) and (Cpd-15) were added to all of the coating solutions so as to have the total coverages of 25.0 mg/m$^2$ and 50 mg/m$^2$, respectively.

Spectral sensitizing dyes illustrated below were added to silver chlorobromide emulsions used for the corresponding light-sensitive emulsion layers:

Blue-Sensitive Emulsion Layer

Sensitizing Dye A

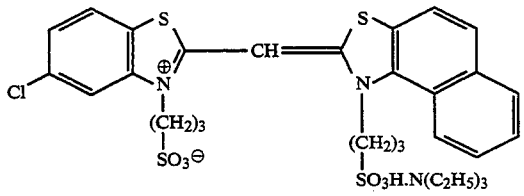

and

Sensitizing Dye B

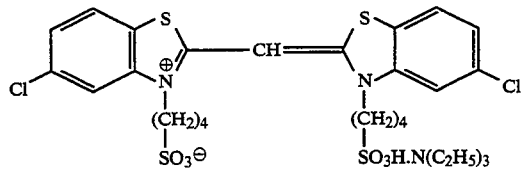

(which were each added to the large-sized emulsion in the amount of $2.0\times10^{-4}$ mole/mole Ag and to the small-sized emulsion in the amount of $2.5\times10^{-4}$ mole/mole Ag)

Green-Sensitive Emulsion Layer

Sensitizing Dye C

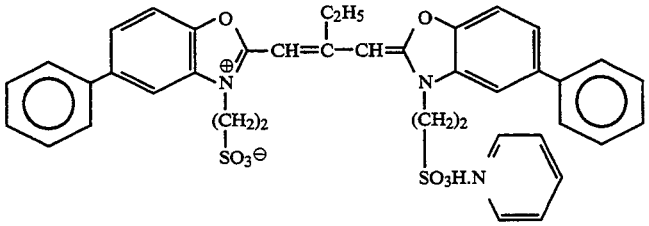

(which was added to the large-sized emulsion in the amount of $4.0\times10^{-4}$ mole/mole Ag and to the small-sized emulsion in the amount of $5.6\times10^{-4}$ mole/mole Ag)

Sensitizing Dye D

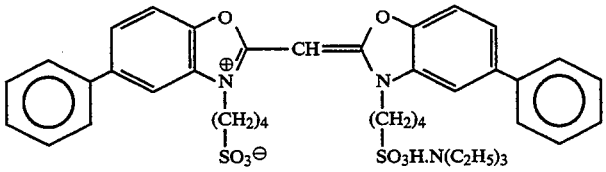

(which was added to the large-sized emulsion in the amount of $7.0\times10^{-5}$ mole/mole Ag and to the small-sized emulsion in the amount of $1.0\times10^{-5}$ mole/mole Ag)

Red-Sensitive Emulsion Layer

Sensitizing dye E

-continued

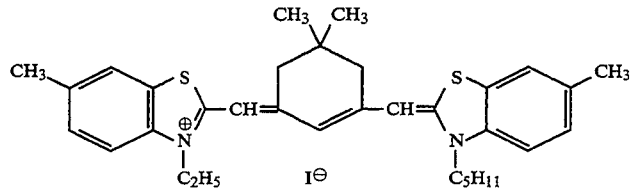

Compound F

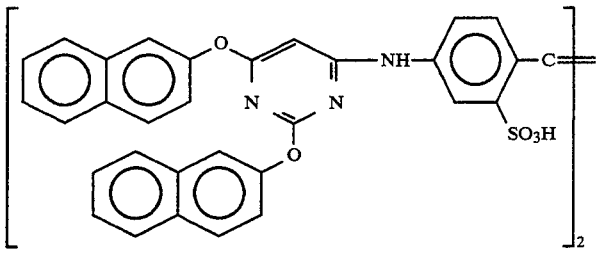

Further, 1-(5-methylureidophenyl)-5-mercaptotetrazole was incorporated into the blue-sensitive, the green-sensitive and the red-sensitive emulsion layers in the amounts of $8.5\times10^{-5}$ mole/mole Ag, $7.7\times10^{-4}$ mole/mole Ag and $2.5\times10^{-4}$ mole/mole Ag, respectively.

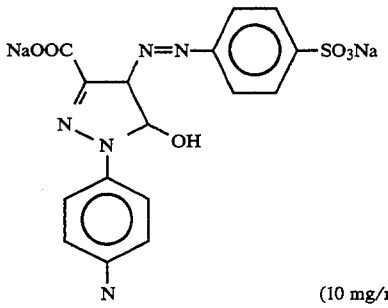

(10 mg/m²)

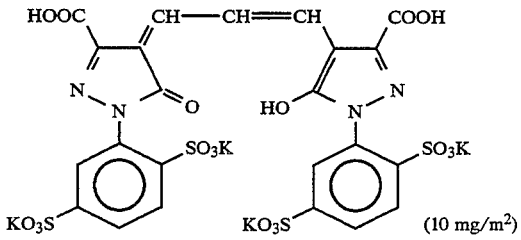

(10 mg/m²)

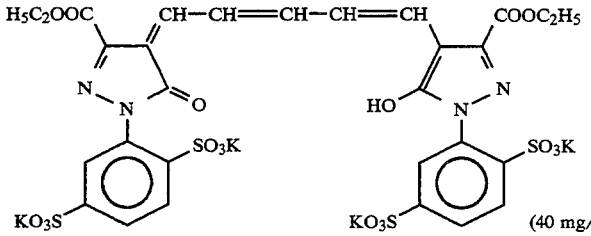

(40 mg/m²)

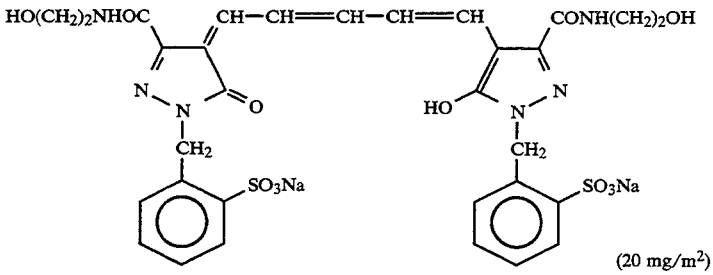

(20 mg/m²)

Furthermore, 4-hydroxy-6-methyl-1,3,3a,7-tetrazaindene was incorporated into the blue-sensitive and the green-sensitive emulsion layers in the amounts of $1\times10^{-4}$ mole/mole Ag and $2\times10^{-4}$ mole/mole Ag, respectively, In addition, the dyes illustrated below (wherein each figure in parentheses represents the coverage thereof) were incorporated in the emulsion layers in order to prevent the irradiation phenomenon.

The composition of each constituent layer is described below. Each figure on the right side represents a coverage (g/m²) of the ingredient corresponding thereto. As for the silver halide emulsion, the figure represents a coverage based on silver.

Support:

Polyethylene-laminated paper [containing white pigment ($TiO_2$) and a bluish dye (ultramarine) in the polyethylene laminate on the side of the first layer]

| | |
|---|---|
| First layer (blue-sensitive emulsion layer): | |
| Silver chlorobromide emulsion [3:7 (by mole based on Ag) mixture of a large-sized Emulsion A having a cubic crystal shape, an average grain size of 0.88 μm and a variation coefficient of 0.08 with respect to size distribution and a small-sized Emulsion A having a cubic crystal shape, an average grain size of 0.70 μm and a variation coefficient of 0.10 with respect to size distribution, which both contained 0.3 mol % of AgBr localized in part of the grain surface] | 0.22 |
| Gelatin | 1.20 |
| Yellow Coupler (ExY) | 0.65 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Second Layer (color stain inhibiting layer): | |
| Gelatin | 1.10 |
| Color stain inhibitor (Cpd-4) | 0.08 |
| Solvent (Solv-6) | 0.04 |
| Solvent (Solv-2) | 0.30 |
| Solvent (Solv-3) | 0.30 |
| Third layer (green-sensitive emulsion layer): | |
| Silver chlorobromide emulsion [1:3 (by mole based on Ag) mixture of a large-sized Emulsion B having a cubic crystal shape, an average grain size of 0.55 μm and a variation coefficient of 0.10 with respect to size distribution and a small-sized Emulsion B having a cubic crystal shape, an average grain size of 0.39 μm and a variation coefficient of 0.08 with respect to size distribution, which both contained 0.8 mol % of AgBr localized in part of the grain surface] | 0.13 |
| Gelatin | 1.45 |
| Magenta coupler (ExM-1) | 0.16 |
| Color image stabilizer (Cpd-5) | 0.15 |
| Color image stabilizer (Cpd-2) | 0.03 |
| Color image stabilizer (Cpd-6) | 0.01 |
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (color stain inhibiting layer): | |
| Gelatin | 0.80 |
| Color stain inhibitor (Cpd-4) | 0.06 |
| Solvent (Solv-7) | 0.03 |
| Solvent (Solv-2) | 0.20 |
| Solvent (Solv-3) | 0.20 |
| Fifth layer (red-sensitive emulsion layer): | |
| Silver chlorobromide emulsion [1:4 (by mole based on Ag) mixture of a large-sized Emulsion C having a cubic crystal shape, an average grain size of 0.50 μm and a variation coefficient of 0.09 with respect to size distribution and a small-sized Emulsion C having a cubic crystal shape, an average grain size of 0.41 μm and a variation coefficient of 0.11 with respect to size distribution, which both contained 0.8 mol % of AgBr localized in part of the grain surface] | 0.20 |
| Gelatin | 0.90 |
| Cyan coupler (ExC-2) | 0.30 |
| Ultraviolet absorbent (UV-2) | 0.18 |
| Color image stabilizer (Cpd-1) | 0.30 |
| Color image stabilizer (Cpd-9) | 0.01 |
| Color image stabilizer (Cpd-10) | 0.01 |
| Color image stabilizer (Cpd-11) | 0.01 |
| Solvent (RS-1) | 0.15 |
| Color image stabilizer (Cpd-8) | 0.01 |
| Color image stabilizer (Cpd-6) | 0.01 |
| Sixth layer (ultraviolet absorbing layer): | |
| Gelatin | 0.55 |
| Ultraviolet absorbent (UV-1) | 0.38 |
| Color image stabilizer (Cpd-12) | 0.15 |
| Color image stabilizer (Cpd-5) | 0.02 |
| Seventh layer (protective layer): | |
| Gelatin | 1.13 |
| Acryl-modified polyvinyl alcohol copolymer (modification degree: 17%) | 0.05 |
| Liquid paraffin | 0.02 |
| Color image stabilizer (Cpd-13) | 0.01 |

(ExY) Yellow Coupler

-continued
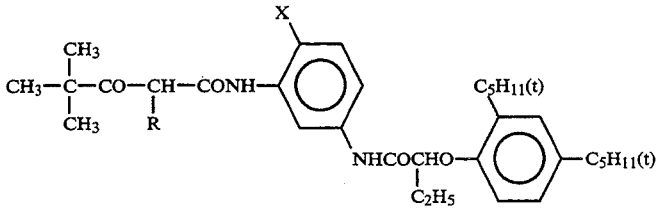
1:1:1 (by mole) mixture of that containing
R = 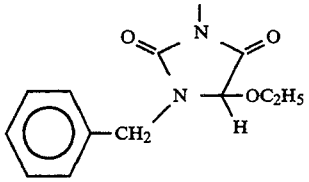 X = Cl,
that containing
R = 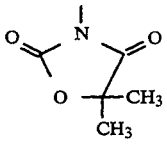 X = $OCH_3$,
and
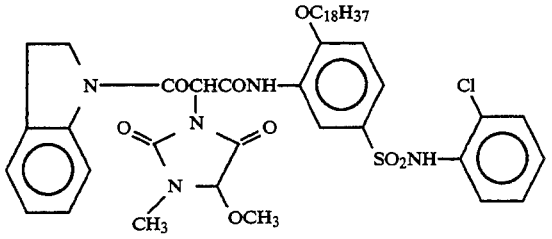
(Cpd-1) Color Image Stabilizer
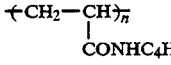
average molecular weight: 60,000
(Cpd-2) Color Image Stabilizer
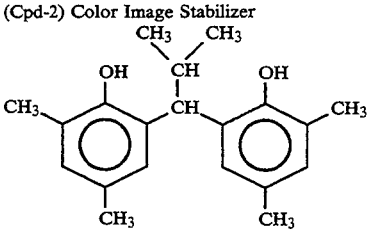
(Cpd-3) Color Image Stabilizer
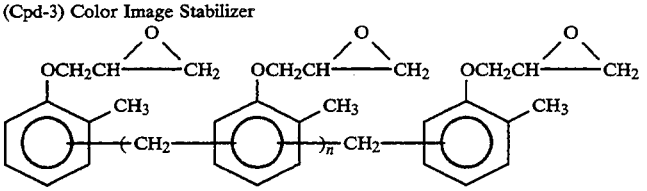
n = 7–8 (on average)
(Cpd-4) Color Stain Inhibitor
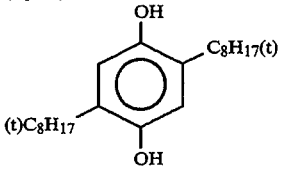

-continued
(Cpd-5) Color Image Stabilizer
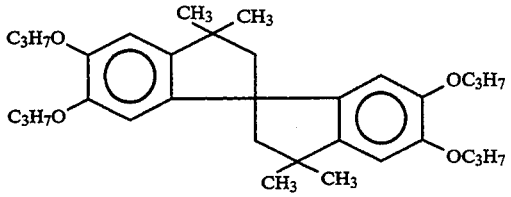
(Cpd-6) Color Image Stabilizer
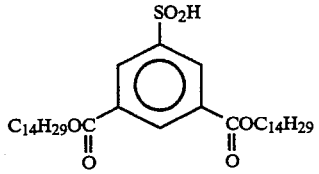
(Cpd-7) Color Image Stabilizer
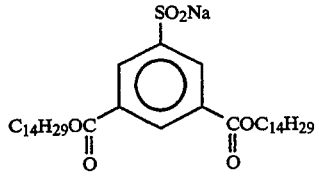
(Cpd-8) Color Image Stabilizer
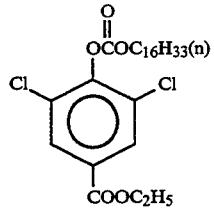
(Cpd-9) Color Image Stabilizer
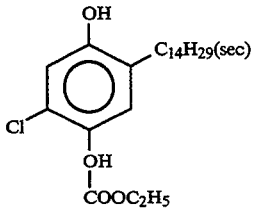
(Cpd-10) Color Image Stabilizer
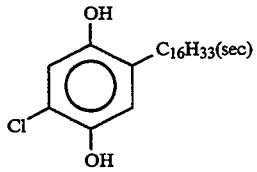
(Cpd-11) Color Image Stabilizer
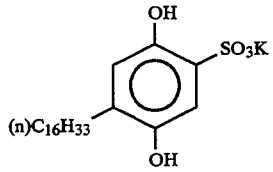
(Cpd-12)

-continued
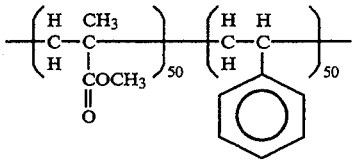
average molecular weight: 60,000
(Cpd-13)
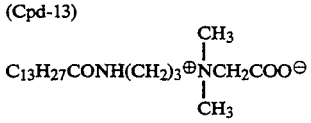
(Cpd-14) Antiseptic
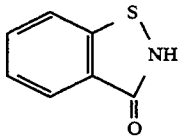
(Cpd-15) Antiseptic
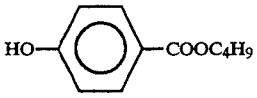
(UV-1) Ultraviolet Absorbent
10:5:1:5 (by weight) Mixture of the following (1), (2), (3) and (4)
(1)
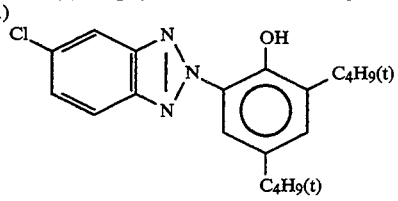
(2)
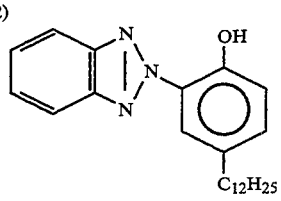
(3)
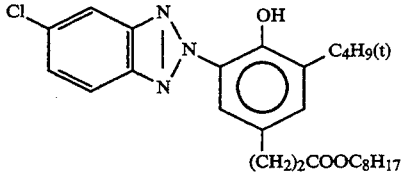
(4)
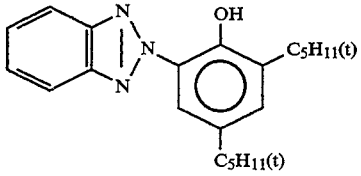
(UV-2) Ultraviolet Absorbent
1:2:2 (by weight) Mixture of the following (1), (2) and (3)
(1)
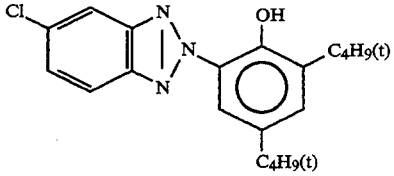
(2)
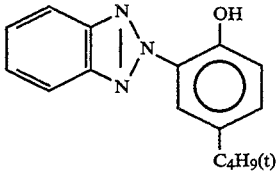
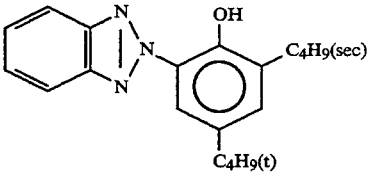
(Solv-1) Solvent
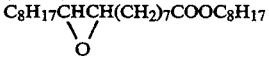

-continued (Solv-2) Solvent

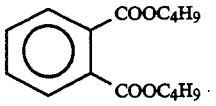

(Solv-3) Solvent

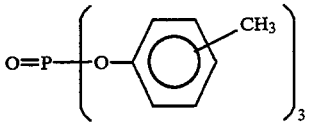

(Solv-4) Solvent

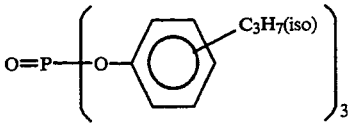

(Solv-5) Solvent

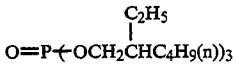

(Solv-6) Solvent

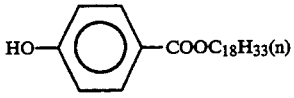

(ExM-1) Magenta Coupler for Comparison:

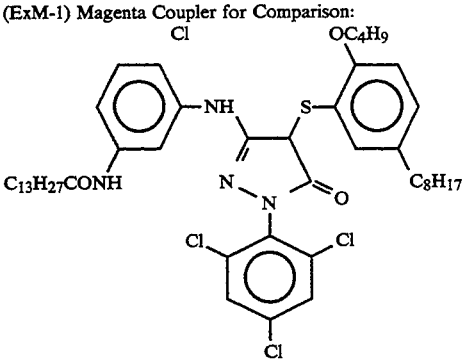

(ExC-2) Cyan Coupler for Comparison:
3:7 (by mole) mixture of

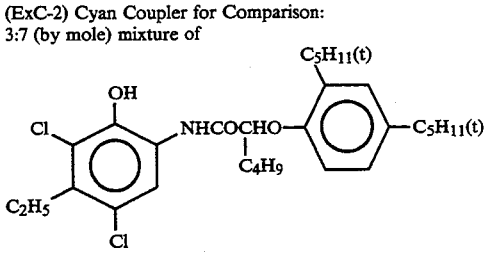

and

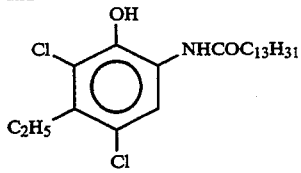

Samples 202 to 261 were prepared in the same manner as Sample 201, except that the magenta coupler in the green-sensitive emulsion layer, the cyan coupler in the red-sensitive emulsion layer and the high boiling organic solvent were replaced so as to be shown in Table B. (Additionally, when the present cyan couplers were used therein, their coverage was one-half the coverage of the cyan coupler for comparison use.)

The structural formulae of the high boiling organic solvents used for comparison in this example are illustrated below:

| High Boiling Organic Solvent used for Comparison | Dielectric Constant (25° C., 10 KHz) |
|---|---|
| RS-1 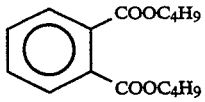  | 6.45 |
| RS-2 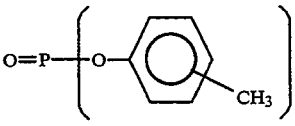  | 7.33 |

-continued

| High Boiling Organic Solvent used for Comparison | Dielectric Constant (25° C., 10 KHz) |
|---|---|
| RS-3 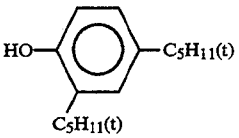 | 3.25 |
| RS-4 $O{=}P{-}(OC_6H_{13}\text{-}n)_3$ | 5.86 |

Then, Sample 201 was exposed with a sensitometer (Model FWH, produced by Fuji Photo Film Co., Ltd.), and the thus exposed sample was used for continuous processing by means of a paper processing machine in which the processing operation was performed in accordance with the following processing steps using the processing solutions having the compositions described below respectively. By this procedure, the development-processing condition in a running equilibrium state was made.

| Processing Step | Temperature | Time | Amount replenished* | Tank Volume |
|---|---|---|---|---|
| Color Development | 35° C. | 45 sec. | 161 ml | 17 l |
| Bleach-Fix | 30–35° C. | 45 sec. | 215 ml | 17 l |
| Rinsing | 30–35° C. | 90 sec. | 350 ml | 10 l |
| Drying | 70–80° C. | 60 sec. | | |

*per $m^2$ of photosensitive material.

The composition of each processing solution is described below.

| Color Developer: | Tank Soln. | Replenisher |
|---|---|---|
| Water | 800 ml | 800 ml |
| Ethylenediamine-N,N,N,N-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl)hydrazine | 5.5 g | 7.0 g |
| Brightening agent (WHITEX 4B, products of Sumitomo Chemical Industry Co., Ltd.) | 1.0 g | 2.0 g |
| Water to make | 1000 ml | 1000 ml |
| pH (25° C.) adjusted to | 10.05 | 10.45 |

| Bleach-Fix Bath (Tank Solution = Replenisher): | |
|---|---|
| Water | 400 ml |
| Ammonium thiosulfate (700 g/l) | 100 ml |
| Sodium sulfite | 17 g |
| Ammonium ethylenediaminetetraacetonatoferrate(III) | 55 g |
| Disodium ethylenediaminetetraacetate | 5 g |
| Ammonium bromide | 40 g |
| Water to make | 1000 ml |
| pH (25° C.) adjusted to | 6.0 |

Rinsing Solution (Tank solution=Replenisher)

Ion exchange water (the concentrations of calcium and magnesium ions each were below 3 ppm).

Then, each sample was subjected to gradation exposure through three-color separation optical wedges for sensitometry by using a sensitometer (Model FWH, produced by Fuji Photo Film Co., Ltd.).

Each of the thus exposed samples was processed by the foregoing paper processing machine using the running solutions described above.

Each of the processed samples which had been exposed so that the developed cyan color might have a density of 1.5 in the area exposed to blue rays of light was examined for yellow density DB through the measurement with Blue filter and for magenta density DG through the measurement with Green filter. From the thus obtained density values were determined the Y-component and the M-component defined by the following equations:

$$\text{Y-component}=DB/1.5 \quad \text{M-component}=DG/1.5$$

The values of these components mean that the cyan absorption is attended by less side absorption the smaller they are, that is, it can ensure more faithful color reproduction the smaller they are.

For the purpose of examining the generation of stain upon long-range storage, other pieces of the processed samples were subjected to a forced test such that they were allowed to stand for one week under a condition of 80° C. and 70% RH, and the resulting samples were examined for change in the white area.

The results obtained are shown in Table B.

TABLE B

| Sample No. | Green-Senstitive Layer Magenta Coupler | Red-Sensitive Layer Cyan Coupler | High Boiling Organic Solvent Species | O/C Ratio | Stains M-stain | Stains C-stain | Hue (cyan) M-Component | Hue (cyan) Y-Component | Note |
|---|---|---|---|---|---|---|---|---|---|
| 201 | ExM-1 | ExC-1 | RS-1 | 0.5 | 0.12 | 0.01 | 0.27 | 0.17 | comparison |
| 202 | | | RS-1 | 1.0 | 0.12 | 0.02 | 0.27 | 0.17 | " |
| 203 | | | RS-1 | 2.5 | 0.14 | 0.02 | 0.27 | 0.17 | " |
| 204 | | | RS-1 | 4.0 | 0.16 | 0.03 | 0.27 | 0.17 | " |
| 205 | ExM-1 | ExC-1 | S-2 | 0.5 | 0.12 | 0.01 | 0.27 | 0.16 | " |
| 206 | | | S-2 | 1.0 | 0.12 | 0.02 | 0.27 | 0.16 | " |
| 207 | | | S-2 | 2.5 | 0.13 | 0.02 | 0.27 | 0.16 | " |
| 208 | | | S-2 | 4.0 | 0.14 | 0.02 | 0.27 | 0.16 | " |
| 209 | II-7 | ExC-1 | RS-1 | 0.5 | 0.12 | 0.01 | 0.27 | 0.17 | " |
| 210 | | | RS-1 | 1.0 | 0.14 | 0.02 | 0.27 | 0.17 | " |
| 211 | | | RS-1 | 2.5 | 0.17 | 0.03 | 0.27 | 0.17 | " |
| 212 | | | RS-1 | 4.0 | 0.20 | 0.05 | 0.27 | 0.17 | " |
| 213 | II-7 | ExC-1 | S-2 | 0.5 | 0.02 | 0.01 | 0.27 | 0.16 | " |
| 214 | | | S-2 | 1.0 | 0.02 | 0.02 | 0.27 | 0.16 | " |
| 215 | | | S-2 | 2.5 | 0.02 | 0.02 | 0.27 | 0.16 | " |
| 216 | | | S-2 | 4.0 | 0.02 | 0.03 | 0.27 | 0.16 | " |
| 217 | | | S-9 | 4.0 | 0.02 | 0.01 | 0.27 | 0.16 | " |

TABLE B-continued

| Sample No. | Green-Senstitive Layer Magenta Coupler | Red-Sensitive Layer Cyan Coupler | High Boiling Organic Solvent Species | O/C Ratio | Stains M-stain | C-stain | Hue (cyan) M-Component | Y-Component | Note |
|---|---|---|---|---|---|---|---|---|---|
| 218 | | | S-29 | 4.0 | 0.02 | 0.01 | 0.27 | 0.16 | " |
| 219 | | | S-30 | 4.0 | 0.02 | 0.01 | 0.27 | 0.09 | " |
| 220 | II-7 | I-21 | RS-1 | 0.5 | 0.13 | 0.01 | 0.27 | 0.09 | " |
| 221 | | | RS-1 | 1.0 | 0.14 | 0.03 | 0.27 | 0.09 | " |
| 222 | | | RS-1 | 2.5 | 0.17 | 0.04 | 0.27 | 0.09 | " |
| 223 | | | RS-1 | 4.0 | 0.21 | 0.06 | 0.27 | 0.09 | " |
| 224 | | | RS-2 | 4.0 | 0.29 | 0.08 | 0.20 | 0.09 | " |
| 225 | | | RS-3 | 4.0 | 0.32 | 0.09 | 0.19 | 0.09 | " |
| 226 | | | RS-4 | 4.0 | 0.25 | 0.09 | 0.19 | 0.09 | " |
| 227 | II-7 | I-21 | S-2 | 0.5 | 0.02 | 0.01 | 0.28 | 0.09 | invention |
| 228 | | | S-2 | 1.0 | 0.02 | 0.01 | 0.25 | 0.09 | " |
| 229 | | | S-2 | 2.5 | 0.02 | 0.01 | 0.21 | 0.09 | " |
| 230 | | | S-2 | 4.0 | 0.02 | 0.01 | 0.19 | 0.09 | " |
| 231 | | | S-29 | 0.5 | 0.02 | 0.01 | 0.28 | 0.09 | " |
| 232 | | | S-29 | 1.0 | 0.02 | 0.01 | 0.24 | 0.09 | " |
| 233 | | | S-29 | 2.5 | 0.02 | 0.01 | 0.22 | 0.09 | " |
| 234 | | | S-29 | 4.0 | 0.02 | 0.01 | 0.20 | 0.09 | " |
| 235 | | | S-13 | 1.0 | 0.02 | 0.01 | 0.25 | 0.09 | " |
| 236 | | | S-13 | 4.0 | 0.02 | 0.01 | 0.20 | 0.09 | " |
| 237 | | | S-21 | 1.0 | 0.02 | 0.01 | 0.26 | 0.09 | " |
| 238 | | | S-21 | 4.0 | 0.02 | 0.01 | 0.21 | 0.09 | " |
| 239 | | | S-23 | 1.0 | 0.02 | 0.01 | 0.27 | 0.09 | " |
| 240 | | | S-23 | 4.0 | 0.02 | 0.01 | 0.22 | 0.09 | " |
| 241 | | | S-25 | 1.0 | 0.02 | 0.01 | 0.28 | 0.09 | " |
| 242 | | | S-25 | 4.0 | 0.02 | 0.01 | 0.21 | 0.09 | " |
| 243 | | | S-27 | 1.0 | 0.01 | 0.01 | 0.25 | 0.09 | " |
| 244 | | | S-27 | 4.0 | 0.01 | 0.01 | 0.20 | 0.09 | " |
| 245 | | | S-28 | 1.0 | 0.02 | 0.01 | 0.26 | 0.09 | " |
| 246 | | | S-28 | 4.0 | 0.02 | 0.01 | 0.20 | 0.09 | " |
| 247 | | | S-29 | 1.0 | 0.02 | 0.01 | 0.27 | 0.09 | " |
| 248 | | | S-29 | 4.0 | 0.02 | 0.01 | 0.20 | 0.09 | " |
| 249 | | | S-32 | 1.0 | 0.01 | 0.01 | 0.27 | 0.09 | " |
| 250 | | | S-32 | 4.0 | 0.01 | 0.01 | 0.21 | 0.09 | " |
| 251 | II-1 | I-14 | RS-1 | 4.0 | 0.22 | 0.06 | 0.25 | 0.10 | comparison |
| 252 | | | RS-2 | 4.0 | 0.28 | 0.08 | 0.18 | 0.09 | " |
| 253 | | | RS-3 | 4.0 | 0.31 | 0.09 | 0.18 | 0.09 | " |
| 254 | | | RS-4 | 4.0 | 0.25 | 0.07 | 0.18 | 0.10 | " |
| 255 | II-1 | I-14 | S-2 | 4.0 | 0.02 | 0.01 | 0.19 | 0.10 | invention |
| 256 | | | S-13 | 4.0 | 0.02 | 0.01 | 0.19 | 0.10 | " |
| 257 | | | S-21 | 4.0 | 0.02 | 0.01 | 0.21 | 0.10 | " |
| 258 | | | S-23 | 4.0 | 0.02 | 0.01 | 0.22 | 0.10 | " |
| 259 | | | S-27 | 4.0 | 0.02 | 0.01 | 0.20 | 0.10 | " |
| 260 | | | S-28 | 4.0 | 0.03 | 0.01 | 0.21 | 0.10 | " |
| 261 | | | S-32 | 4.0 | 0.02 | 0.01 | 0.20 | 0.10 | " |

The term "O/C ratio" in Table B refers to the ratio, by weight, of a high boiling organic solvent to a cyan coupler used together therewith.

From the data shown in Table B, it has turned out that:

(1) the samples in which a magenta coupler for comparison, other than present ones, a cyan coupler for comparison, other than the present ones, and a high boiling organic solvent other than the present ones were employed in combination (Samples 201–204), though they little generate cyan stain (C-stain), were inferior in magenta stain (M-stain) and hue to the present samples, (2) even when high boiling organic solvents, other than the present ones, were replaced by the oils of the present invention in the foregoing case (1), any satisfactory improvement was not produced in a practical sense (Samples 205–208), (3) the samples in which a magenta coupler according to the present invention, a cyan coupler according to the present invention and a high boiling organic solvent for comparison were used in combination generated M-stain and C-stain to such extents as not to withstand the practical use, though their hue was certainly improved (Samples 220–226), and (4) the samples in which a magenta coupler according to the present invention, a cyan coupler according to the present invention and a high boiling organic solvent according to the present invention were used in combination were superior in all of hue, M-stain and C-stain, and the effect brought about by said combined use became greater when the O/C ratio was not smaller than 1.

EXAMPLE 3

The same samples as prepared in Example 2 were examined for blix stain. The term "blix stain" used herein refers to the stain arising from indiscriminate color formation of couplers in the bleach or blix step. The generation of blix stain is promoted by the accumulation of a developing agent and the rise in pH which are caused by the developer's being brought into a bleach or blix bath.

Specifically, some of the same unprocessed samples as used in Example 2 (set forth in Table C) were subjected to the same photographic processing as employed in Example 2, except that the blix operation was performed using the blix bath which was adjusted to pH 7.0 after it had undergone the running operation. Just after the photographic processing described above, the density of cyan color in the white area of each sample was measured. On the other hand, other pieces of the foregoing unprocessed samples were subjected to the same photographic processing as described above, except that the fresh blix bath adjusted to pH 5.0 was used, and examined for cyan color density in the white area. The difference between the densities of cyan colors developed in the white area through the foregoing two kinds of blix operations was taken as a criterion of the blix stain. The results obtained are shown in Table C.

TABLE C

| Sample No. | Blix Stain (ΔD R min) | note |
|---|---|---|
| 220 | 0.06 | comparison |
| 223 | 0.10 | comparison |
| 224 | 0.09 | comparison |
| 225 | 0.08 | comparison |
| 226 | 0.07 | comparison |
| 251 | 0.08 | comparison |
| 252 | 0.09 | comparison |
| 253 | 0.11 | comparison |
| 254 | 0.09 | comparison |
| 227 | 0.03 | invention |
| 230 | 0.02 | invention |
| 231 | 0.03 | invention |
| 232 | 0.02 | invention |
| 233 | 0.01 | invention |
| 234 | 0.01 | invention |
| 236 | 0.00 | invention |
| 238 | 0.02 | invention |
| 240 | 0.01 | invention |
| 242 | 0.01 | invention |
| 244 | 0.01 | invention |
| 246 | 0.01 | invention |
| 248 | 0.01 | invention |
| 250 | 0.01 | invention |
| 255 | 0.02 | invention |
| 256 | 0.01 | invention |
| 257 | 0.01 | invention |
| 258 | 0.02 | invention |
| 259 | 0.01 | invention |
| 260 | 0.01 | invention |

As can be seen from the data set forth in Table C, the blix stain was generated to an appreciable extent when the present cyan couplers were used in combination with high boiling organic solvents for comparison, while the combinations of the present cyan couplers with the present high boiling organic solvents enabled a considerable reduction in blix stain generation.

What is claimed is:

1. A silver halide color photosensitive material which comprises a cyan color-forming silver halide emulsion layer provided on a support, said silver halide emulsion layer containing at least one pyrroloazole cyan dye-forming coupler represented by the following general formula (IIIa) and a high boiling organic solvent having the following general formula (S) and a dielectric constant of at most 6.0:

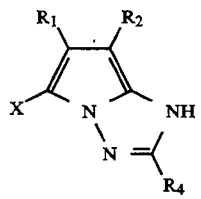

(IIIa)

wherein $R_1$ is a cyano group and $R_2$ is a trifluoromethyl group, a straight or branched unsubstituted alkoxycarbonyl group, an alkoxycarbonyl group substituted with a carbamoyl group, an ether linkage-containing alkoxycarbonyl group, an unsubstituted aryloxycarbonyl group or an alkyl- or alkoxy-substituted aryloxycarbonyl group; $R_4$ represents a hydrogen atom or a substituent group, and when two $R_4$'s are present in the formula they may be the same or different; and X represents a hydrogen atom or a group capable of splitting off by the coupling reaction with the oxidation product of an aromatic primary amine color developing agent:

$$R_5—COOR_6 \quad (S)$$

wherein $R_5$ and $R_6$ each represent a substituted or unsubstituted alkyl, cycloalkyl, alkenyl, aryl or heterocyclyl group.

2. The silver halide color photosensitive material of claim 1, wherein the ratio of the high boiling organic solvent of general formula (S) to the cyan dye-forming coupler of general formula (IIIa) is not less than 1.0 by weight.

3. The silver halide color photosensitive material of claim 2, wherein the ratio of the high boiling organic solvent to the cyan dye-forming coupler ranges from 2 to 10 by weight.

4. The silver halide color photosensitive material of claim 1, wherein the total content of the cyan dye-forming couplers of general formula (IIIa) in the silver halide emulsion layer ranges from $1\times10^{-3}$ to 1 mole per mole of silver halide.

5. The silver halide color photosensitive material of claim 1, wherein the cyan dye-forming couplers of general formula (IIIa) comprise at least 50 mole % of the whole cyan dye-forming couplers contained in the cyan color-forming silver halide emulsion layer.

6. The silver halide color photosensitive material of claim 1, which further has on the support a magenta color-forming silver halide emulsion layer and a yellow color-forming silver halide emulsion layer, said magenta color-forming silver halide emulsion layer containing at least one magenta dye-forming coupler represented by the following general formula (II):

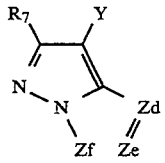

(II)

wherein $R_7$ represents a hydrogen atom or a substituent group; Zd, Ze and Zf each represent an unsubstituted or substituted methine group, =N— or —NH—; and Y represents a hydrogen atom or a group capable of splitting off by the coupling reaction with the oxidation product of a developing agent.

7. The silver halide color photosensitive material of claim 6, wherein the ratio of the high boiling organic solvent of general formula (S) to the cyan dye-forming coupler of general formula (IIIa) is not less than 1.0 by weight.

8. The silver halide color photosensitive material of claim 6, wherein the silver halide emulsion layers each comprise a substantially iodide-free silver chloride or chlorobromide emulsion having a chloride content of at least 90 mole %.

9. The silver halide color photosensitive material of claim 6, wherein the magenta dye-forming couplers of general formula (II) have a total coverage of 0.05 to 2.0 millimole/$m^2$.

10. The silver halide color photosensitive material of claim 6, wherein the total content of the magenta dye-forming couplers of general formula (II) in the magenta color-forming silver halide emulsion layer ranges from $1\times10^{-3}$ to 1 mole per mole of silver halide.

11. The silver halide color photosensitive material of claim 6, wherein the magenta dye-forming couplers of general formula (II) comprises at least 50 mole % of the whole magenta dye-forming couplers contained in the magenta color-forming silver halide emulsion layer.

12. The silver halide color photosensitive material of claim 6, wherein Y in general formula (II) is a halogen or an arylthio group.

13. The silver halide color photosensitive material of claim 6, wherein $R_7$ represents an alkyl group, an alkoxy group, an aryl group or an aryloxy group.

14. The silver halide color photosensitive material of claim 1, wherein $R_4$ is a halogen atom, an aliphatic group, an aryl group, a heterocyclyl group, an alkoxy group, an aryloxy group, a heterocyclyloxy group, an alkyl-, aryl- or heterocyclylthio group, an acyloxy group, a carbamoyloxy group, a silyloxy group, a sulfonyloxy group, an acylamino group, an alkylamino group, an arylamino group, an ureido group, a sulfamoylamino group, an alkenyloxy group, a formyl group, an alkyl-, aryl- or heterocyclylacyl group, an alkyl-, aryl- or heterocyclylsulfonyl group, an alkyl-, aryl- or heterocyclylsulfinyl group, an alkyl-, aryl- or heterocyclyloxycarbonyl group, an alkyl-, aryl or heterocyclyloxycarbonylamino group, a sulfonamido group, a carbamoyl group, a sulfamoyl group, a phosphonyl group, a sulfamido group, an imido group, an azolyl group, a hydroxy group, a cyano group, a carboxyl group, a nitro group, a sulfo group, and an unsubstituted amino group.

15. The silver halide color photosensitive material of claim 1, wherein $R_4$ is an alkyl group, an aryl group, a heterocyclyl group, a cyano group, a nitro group, an acylamino group, an arylamino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocylyloxy group, an acyloxy group, a carbamoyloxy group, an aryloxycarbonylamino group, an imido group, a heterocyclylthio group, a sulfinyl group, a phosphonyl group, an acyl group and an azolyl group.

16. The silver halide color photosensitive material of claim 1, wherein $R_4$ is an alkyl or an aryl group which are optionally substituted with at least one alkoxy, sulfonyl, sulfamoyl, carbamoyl, acylamido or sulfonamido groups.

* * * * *